US009505528B2

(12) United States Patent
Walker et al.

(10) Patent No.: US 9,505,528 B2
(45) **Date of Patent: *Nov. 29, 2016**

(54) DRINK CUP AND LID

(75) Inventors: Thomas B. Walker, Evansville, IN (US); Milan C. Maravich, Newburgh, IN (US); David O'Nan, Henderson, KY (US)

(73) Assignee: Berry Plastics Corporation, Evansville, IN (US)

( * ) Notice: Subject to any disclaimer, the term of this patent is extended or adjusted under 35 U.S.C. 154(b) by 842 days.

This patent is subject to a terminal disclaimer.

(21) Appl. No.: 13/290,785

(22) Filed: Nov. 7, 2011

(65) Prior Publication Data

US 2012/0048856 A1 Mar. 1, 2012

Related U.S. Application Data

(63) Continuation of application No. 11/828,144, filed on Jul. 25, 2007, now Pat. No. 8,074,831, and a continuation-in-part of application No. 11/210,085, filed on Aug. 23, 2005, now Pat. No. 7,318,536, and a continuation-in-part of application No. 10/824,753, filed on Apr. 15, 2004, now Pat. No. 7,055,715.

(51) Int. Cl.
*B65D 43/02* (2006.01)

(52) U.S. Cl.
CPC ..... *B65D 43/0208* (2013.01); *B65D 2203/00* (2013.01); *B65D 2231/022* (2013.01); *B65D 2543/00027* (2013.01); *B65D 2543/0062* (2013.01); *B65D 2543/00092* (2013.01); *B65D 2543/00296* (2013.01); *B65D 2543/00407* (2013.01); *B65D 2543/00509* (2013.01); *B65D 2543/00555* (2013.01); *B65D 2543/00657* (2013.01); *B65D 2543/00685* (2013.01); *B65D 2543/00731* (2013.01); *B65D 2543/00796* (2013.01); *B65D 2543/00805* (2013.01)

(58) Field of Classification Search
USPC ..... 220/711, 780, 783, 790, 791, 792, 793, 220/789
See application file for complete search history.

(56) References Cited

U.S. PATENT DOCUMENTS

| | | | | |
|---|---|---|---|---|
| 2,985,354 | A | 5/1961 | Aldington | |
| 3,048,317 | A | 8/1962 | Cochrane et al. | |
| 3,055,540 | A * | 9/1962 | Ringlen | 220/789 |
| 3,065,875 | A * | 11/1962 | Negoro | 220/784 |
| 3,262,602 | A | 7/1966 | McConnell et al. | |
| 3,301,459 | A * | 1/1967 | Gardner | 220/266 |
| 3,349,950 | A | 10/1967 | Wanderer | |
| 3,604,588 | A * | 9/1971 | Winnick | 220/782 |
| 3,609,263 | A * | 9/1971 | Clementi | 220/792 |

(Continued)

FOREIGN PATENT DOCUMENTS

DE 20116771 12/2001

OTHER PUBLICATIONS

International Search Report and Written Opinion dated Jul. 9, 2008, for PCT/US2008/054888.

(Continued)

*Primary Examiner* — Fenn Mathew
*Assistant Examiner* — Jennifer Castriotta
(74) *Attorney, Agent, or Firm* — Barnes & Thomburg LLP

(57) ABSTRACT

A liquid container includes a brim forming an opening into a liquid reservoir chamber formed in the cup. A lid is coupled to the brim to form more than one seal with the container.

6 Claims, 16 Drawing Sheets

(56) References Cited

U.S. PATENT DOCUMENTS

| | | | | | |
|---|---|---|---|---|---|
| 3,610,306 | A | * | 10/1971 | Summers | 215/270 |
| 3,612,342 | A | | 10/1971 | Rathbun | |
| 3,676,089 | A | | 7/1972 | Swett et al. | |
| 3,677,435 | A | | 7/1972 | Davis | |
| 3,679,088 | A | | 7/1972 | Swett et al. | |
| 3,743,133 | A | | 7/1973 | Rathbun | |
| 3,805,991 | A | * | 4/1974 | Cheladze et al. | 220/373 |
| 3,817,420 | A | * | 6/1974 | Heisler | 220/790 |
| 3,840,144 | A | * | 10/1974 | Dry | 220/792 |
| 3,977,563 | A | | 8/1976 | Holt | |
| 4,006,839 | A | | 2/1977 | Thiel et al. | |
| 4,026,459 | A | * | 5/1977 | Blanchard | 229/404 |
| 4,054,229 | A | | 10/1977 | Arfert | |
| 4,210,258 | A | * | 7/1980 | von Holdt | 206/508 |
| 4,266,689 | A | * | 5/1981 | Asher | 220/789 |
| 4,293,080 | A | * | 10/1981 | Letica | 220/790 |
| 4,349,119 | A | * | 9/1982 | Letica | 220/790 |
| 4,351,448 | A | | 9/1982 | Ingersoll et al. | |
| 4,380,305 | A | * | 4/1983 | Von Holdt | 220/782 |
| 4,408,698 | A | * | 10/1983 | Ballester | 220/790 |
| 4,444,332 | A | | 4/1984 | Widen et al. | |
| 4,446,986 | A | * | 5/1984 | Bowen et al. | 220/789 |
| 4,474,305 | A | | 10/1984 | Marco | |
| 4,508,235 | A | | 4/1985 | Steele et al. | |
| 4,518,097 | A | * | 5/1985 | Milton et al. | 220/782 |
| 4,524,882 | A | * | 6/1985 | Buc | 220/783 |
| 4,562,937 | A | | 1/1986 | Iyengar | |
| 4,640,435 | A | * | 2/1987 | Dutt | 220/790 |
| 4,674,644 | A | * | 6/1987 | Jacobs | 215/320 |
| 4,679,699 | A | | 7/1987 | Malsbury et al. | |
| 4,721,210 | A | | 1/1988 | Lawrence et al. | |
| 4,782,976 | A | * | 11/1988 | Kenyon, 2nd. | 220/781 |
| 4,799,602 | A | * | 1/1989 | Collins et al. | 220/789 |
| 4,836,407 | A | * | 6/1989 | Bruce et al. | 220/276 |
| 4,872,586 | A | * | 10/1989 | Landis | 220/781 |
| 4,934,557 | A | | 6/1990 | Smith | |
| 5,377,860 | A | | 1/1995 | Littlejohn et al. | |
| 5,427,266 | A | * | 6/1995 | Yun | 220/377 |
| 5,460,286 | A | * | 10/1995 | Rush et al. | 220/782 |
| 5,820,016 | A | | 10/1998 | Stropkay | |
| 5,839,601 | A | | 11/1998 | Melle | |
| 5,979,690 | A | | 11/1999 | Hartley | |
| 6,021,917 | A | * | 2/2000 | Lovell et al. | 220/782 |
| 6,056,144 | A | * | 5/2000 | Strange et al. | 220/297 |
| 6,196,404 | B1 | | 3/2001 | Chen | |
| 6,257,435 | B1 | | 7/2001 | Chedister et al. | |
| 6,302,288 | B1 | | 10/2001 | Nava et al. | |
| 6,357,619 | B1 | | 3/2002 | Schaefer | |
| 6,419,112 | B1 | * | 7/2002 | Bruce et al. | 220/781 |
| 6,460,716 | B1 | | 10/2002 | Wong | |
| 6,688,487 | B2 | | 2/2004 | Oakes et al. | |
| 6,910,599 | B2 | | 6/2005 | Tucker et al. | |
| 6,932,234 | B2 | * | 8/2005 | D'Amato | 220/781 |
| 6,948,633 | B2 | * | 9/2005 | Freek et al. | 220/711 |
| 6,959,829 | B2 | * | 11/2005 | Crider et al. | 220/276 |
| D516,910 | S | | 3/2006 | Bresler | |
| 7,055,715 | B2 | | 6/2006 | Maravich et al. | |
| 7,159,732 | B2 | | 1/2007 | Smith et al. | |
| 7,225,945 | B2 | * | 6/2007 | Crider et al. | 220/276 |
| 7,284,676 | B2 | * | 10/2007 | Dantani | 220/711 |
| 7,464,831 | B2 | * | 12/2008 | Aiken | 220/801 |
| 2002/0037378 | A1 | | 3/2002 | Littlejohn et al. | |
| 2003/0155353 | A1 | | 8/2003 | Tucker | |
| 2004/0011803 | A1 | * | 1/2004 | D'Amato | 220/780 |
| 2004/0094553 | A1 | * | 5/2004 | Crider et al. | 220/276 |
| 2004/0134911 | A1 | * | 7/2004 | Padovani | 220/4.24 |
| 2004/0159080 | A1 | | 8/2004 | Stewart et al. | |
| 2004/0222226 | A1 | * | 11/2004 | Gottainer et al. | 220/284 |
| 2004/0245261 | A1 | | 12/2004 | Stanos et al. | |
| 2005/0109780 | A1 | | 5/2005 | Pendergrass | |
| 2005/0178766 | A1 | | 8/2005 | Washington et al. | |
| 2005/0224505 | A1 | * | 10/2005 | Brown et al. | 220/792 |
| 2005/0230406 | A1 | | 10/2005 | Maravich et al. | |
| 2005/0269328 | A1 | * | 12/2005 | Crider et al. | 220/276 |
| 2006/0060589 | A1 | | 3/2006 | Lee | |
| 2007/0007298 | A1 | * | 1/2007 | Tucker et al. | 220/791 |
| 2008/0197134 | A1 | * | 8/2008 | Maxwell | 220/367.1 |

OTHER PUBLICATIONS

Supplementary European Search Report dated Jul. 28, 2008, for European Patent Application No. 06813520.1.

Supplementary European Search Report dated Apr. 6, 2009, for European Patent Application No. 05735742.8.

* cited by examiner

DRINK CUP AND LID

CROSS-REFERENCE TO RELATED APPLICATIONS

This application is a continuation of U.S. application Ser. No. 11/828,144, filed Jul. 25, 2007, which is a continuation-in-part of U.S. application Ser. No. 11/210,085, filed Aug. 23, 2005 (now U.S. Pat. No. 7,318,536, issued Jan. 15, 2008), which is a continuation-in-part of U.S. application Ser. No. 10/824,753, filed Apr. 15, 2004 (now U.S. Pat. No. 7,055,715, issued Jun. 6, 2006), all of which are expressly incorporated by reference herein.

BACKGROUND

The present disclosure relates to drink cups, and particularly to lids for drink cups. More particularly, the present disclosure relates to a seal established between a drink cup and a lid mounted on the drink cup.

SUMMARY

According to the present disclosure, a liquid container comprises a cup including a brim, a floor, and a side wall extending from the brim toward the floor. The side wall includes a radially inwardly facing first annular seal surface. The brim includes at least one more annular seal surface.

The liquid container also comprises a lid including a closure and a brim mount appended to the closure and configured to be mounted on the brim of the cup. The brim mount is coupled to the brim to retain the closure in a position closing a mouth opening into a liquid reservoir chamber formed in the cup.

In illustrative embodiments, the lid is configured to mate with a paper cup to establish a "press-plug" interference fit and several liquid flow barriers (i.e., "seals") between the lid and the paper cup. The lid includes a bowl-shaped closure made of an elastic material and configured to deform elasticly when inserted into the mouth opening of the paper cup to establish a sealed tight interference fit between the lid and the paper cup and to reinforce and rigidify an upper portion of the paper cup near the top opening of the paper cup to block radially inward collapse of the paper cup when the paper cup is dropped or impacted.

In illustrative embodiments, the lid includes three seal rings. A first seal ring is included in the bowl-shaped closure and is arranged to engage the radially inwardly facing first annular seal surface on the paper cup to establish a first liquid flow barrier therebetween. A second seal ring is included in the brim mount and is arranged to engage the axially upwardly facing second annular seal surface on the paper cup to establish a second liquid flow barrier therebetween. A third seal ring is included in the brim mount and is arranged to engage the radially outwardly facing third annular seal surface on the paper cup to establish a third liquid flow barrier therebetween.

In illustrative embodiments, the bowl-shaped closure includes a cover (e.g. a round plate) arranged to close most of the mouth opening into the liquid reservoir chamber formed in the paper cup. The first seal ring is arranged to surround the cover and lie in concentric spaced-apart relation to the cover. Spring means is included to interconnect the first seal ring and the cover and configured to generate a force to yieldably urge the first seal ring radially outwardly away from the cover to mate with the radially inwardly facing first annular surface on the paper cup so that the press-plug interference fit between the bowl-shaped closure and the paper cup is established upon mounting the lid on the paper cup.

In illustrative embodiments, an annular lid-removal blocker wall is included in the lid to engage an annular outer portion of the paper cup that is configured to provide a lid retainer to help retain the lid in a mounted position on the paper cup closing the mouth opening into a liquid reservoir chamber formed in the paper cup. The annular lid-removal blocker wall is included in a peripheral portion of the lid and is arranged to engage a lid retainer portion of the brim of the paper cup during movement of the lid in an outer direction away from the floor of the paper cup to assist in blocking unwanted removal of the lid from the paper cup.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
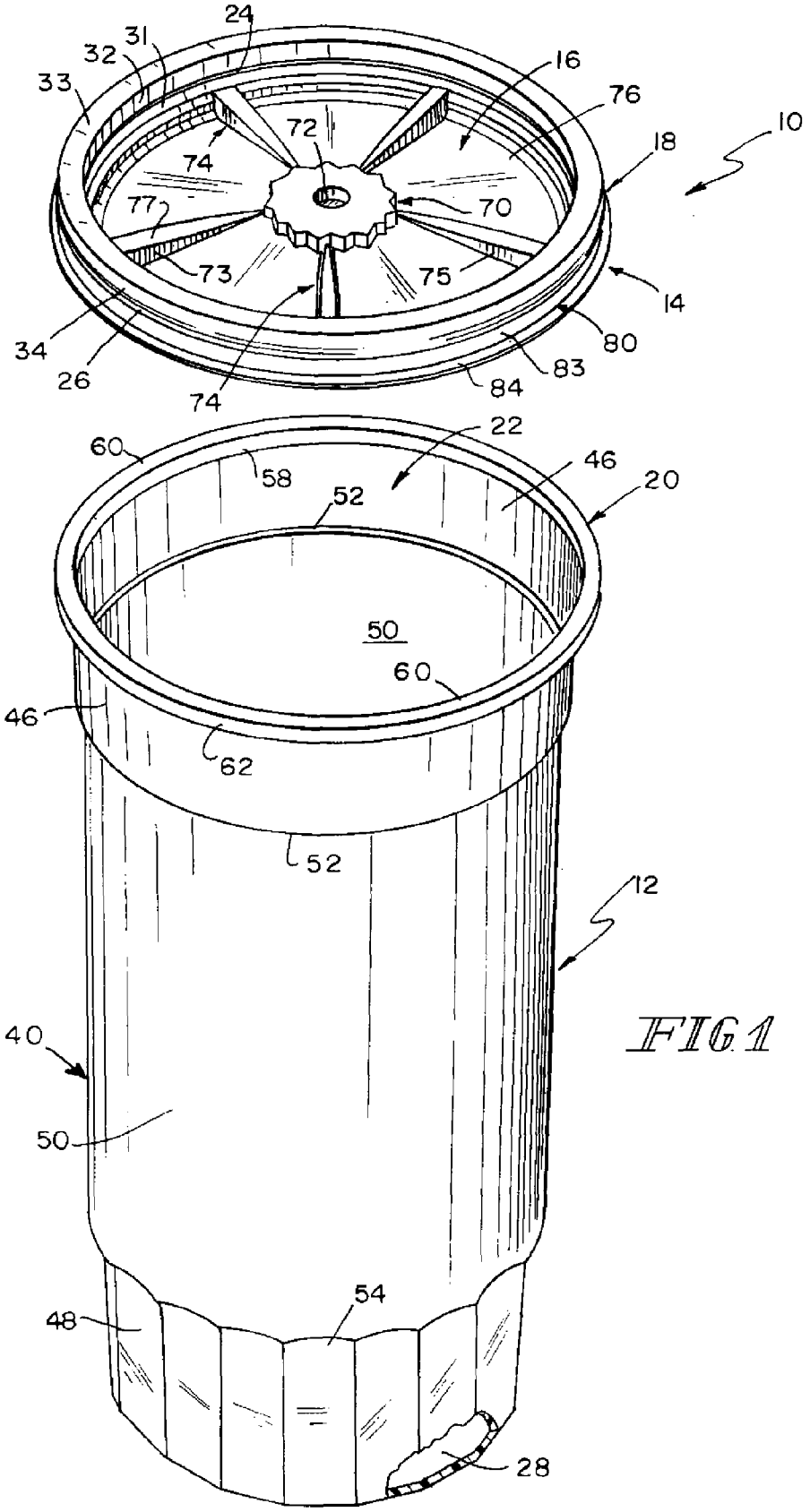
FIG. 1 is a perspective view of a lid in accordance with a first embodiment of the present disclosure and a cup before the lid is mounted on the cup.

A liquid container 10 includes a cup 12 and a lid 14 as shown in FIG. 1. Lid 14 includes a closure 16 and a closure mount 18 configured to be mounted on a brim 20 of cup 12 to arrange closure 16 to close an opening into a liquid reservoir chamber 22 formed in cup 12 as suggested in FIG. 6. A second lid 114 in accordance with the present disclosure is shown in FIGS. 7-12. A third lid 214 in accordance with the present disclosure is shown in FIGS. 13-20. A fourth lid 314 in accordance with the present disclosure is shown in FIGS. 21-29.

In illustrative embodiments, fourth lid 314 is well-suited for use on a paper cup 312. Lids 14, 114, and 214 are well-suited for use on cups made of a plastics material.

Figure 5:
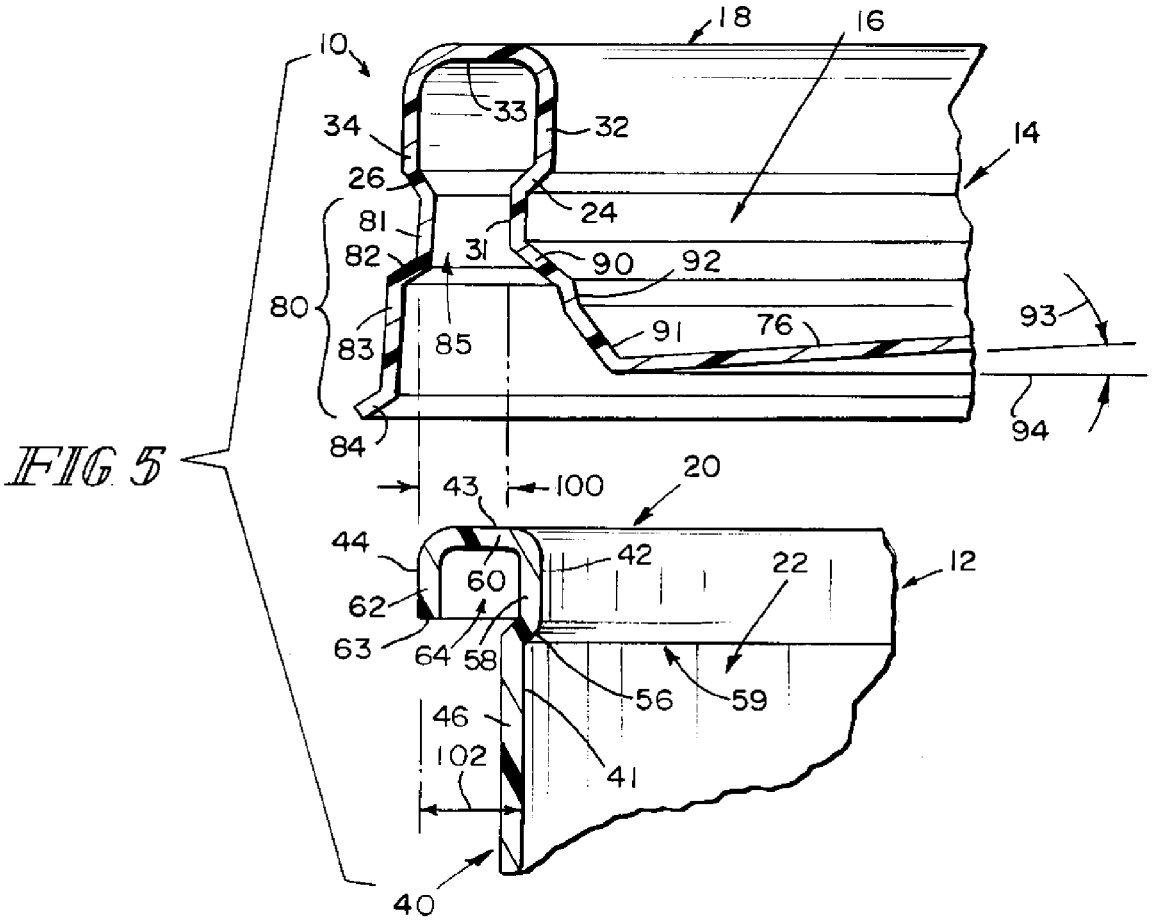
FIG. 5 is an enlarged sectional view of portions of the lid and cup of FIG. 1 before the lid is mounted on the cup.
Figure 6:
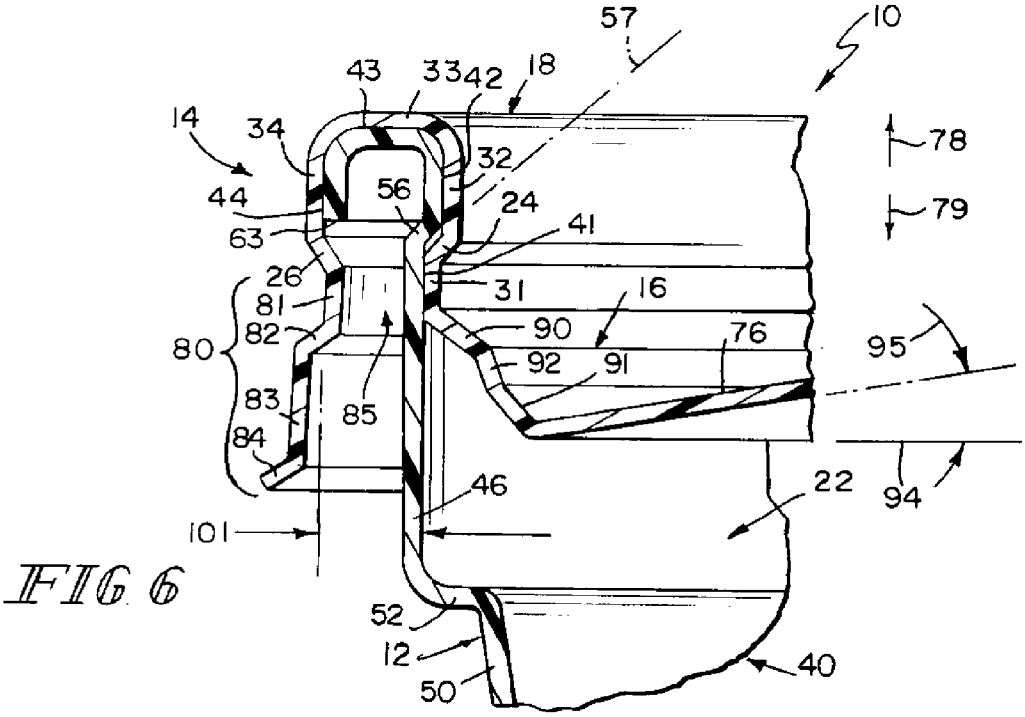
FIG. 6 is a view similar to FIG. 5 after the lid is mounted on the cup showing formation of a series of liquid flow barriers to retain liquid in a reservoir chamber formed in the cup owing to sealing engagement between the closure mount ring of the lid and both of a side wall and the brim of the cup and showing retention of the lid on the cup owing, in part, to engagement of a portion of the lid in an "undercut" formed on an interior surface of the cup at a junction between the side wall and the brim of the cup.
Figure 7:
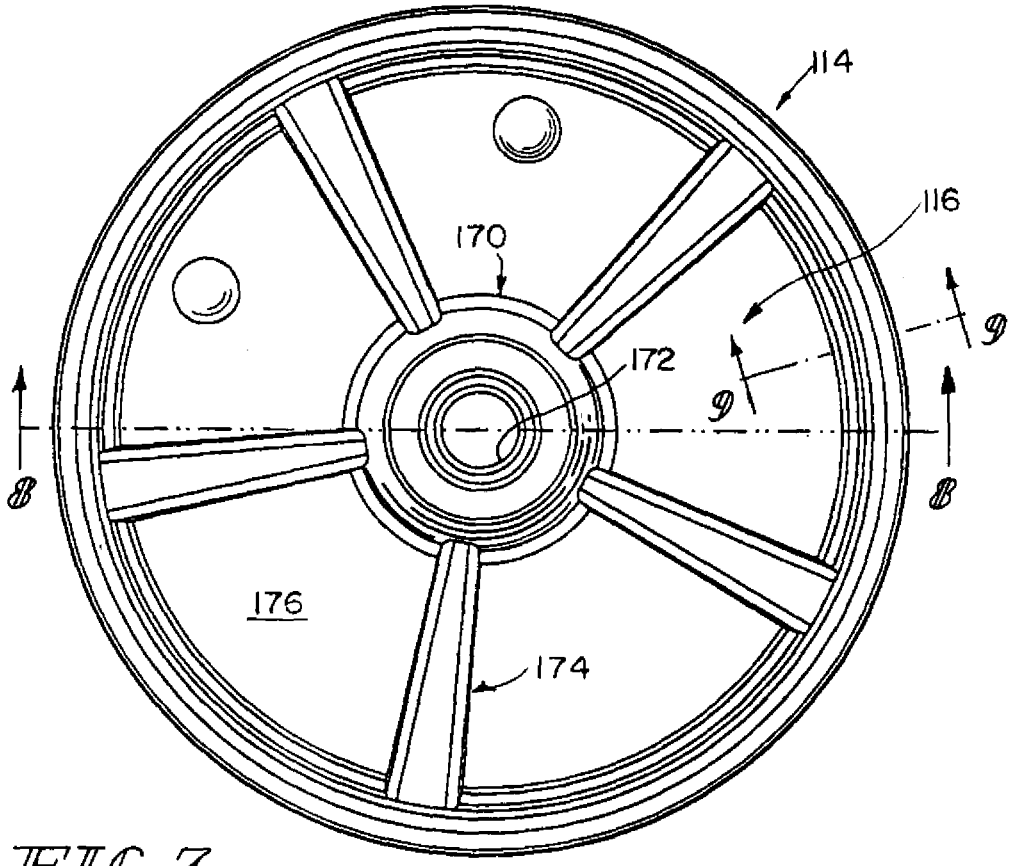
FIG. 7 is a top plan view of a lid in accordance with a second embodiment of the present disclosure.
Figure 8:
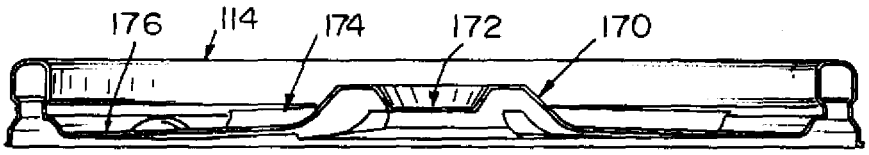
FIG. 8 is a sectional view taken along line 8-8 of FIG. 7.
Figure 9:
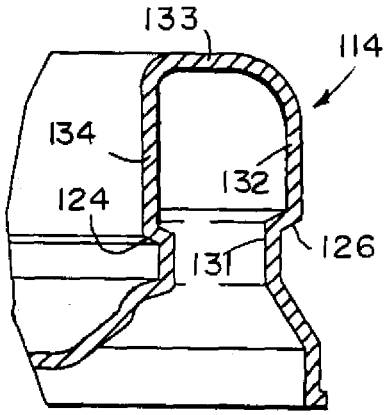
FIG. 9 is an enlarged view of a portion of the lid cross-section of FIG. 8.
Figure 10:
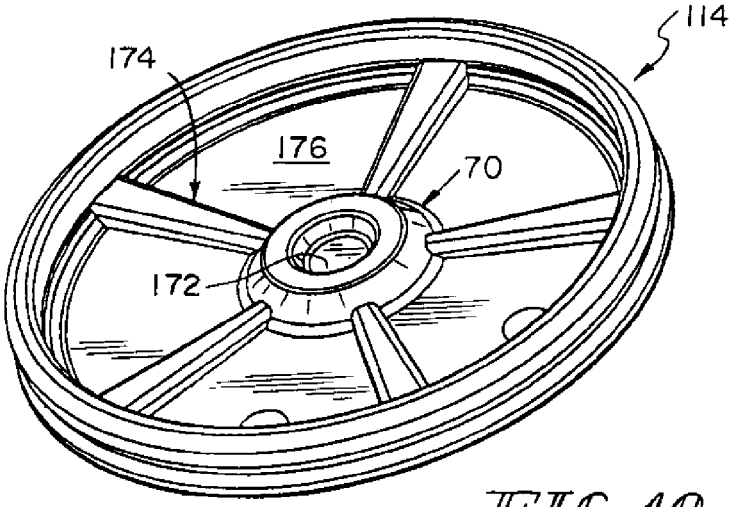
FIG. 10 is a perspective view of the lid of FIG. 7.
Figure 11:
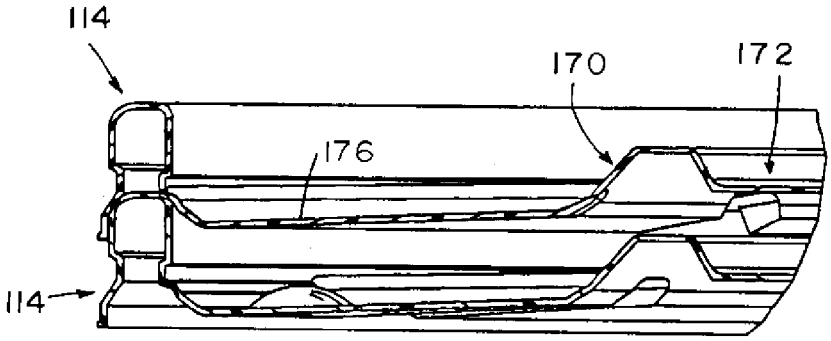
FIG. 11 is a sectional view (similar to FIG. 8) showing a stack comprising two of the lids shown in FIGS. 7 and 10.

In illustrative embodiments, retainers 24, 26 included in lid 14 are arranged to engage portions of cup 12 to block unwanted removal of lid 14 from cup 12 as suggested in FIGS. 5 and 6. Also in illustrative embodiments, four seal rings 31, 32, 33, and 34 are provided on lid 14 to engage companion annular seal surfaces 41, 42, 43, and 44 on cup 12 to establish four liquid flow barriers arranged in series near and on brim 20 to block unwanted discharge of liquid from liquid reservoir chamber 22 while lid 14 is in place on cup 12 as suggested in FIGS. 5 and 6.

As shown in FIG. 1, cup 12 includes brim 20, a floor 28, and a side wall 40 extending from brim 20 to floor 28. Side wall 40 is formed to include a large-diameter top portion 46 appended to brim 20, a small-diameter bottom portion 48, and a body portion 50 located between top and bottom portions 46, 48 as shown in FIG. 1. Side wall 40 also includes an annular top transitional portion 52 interconnecting top portion 46 and body portion 50 as shown, for example, in FIGS. 5 and 6. Side wall 40 also includes a "scalloped" annular bottom transitional portion 54 interconnecting body portion 50 and bottom portion 48 as suggested in FIG. 1.

As shown, for example, in FIG. 5, brim 20 includes, in series, a lid retainer 56, an inner annular strip 58, an annular bridge 60, and an outer annular strip 62. Lid retainer 56 is rooted to an upper portion of top portion 46 to anchor brim 20 to top portion 46. Outer annular strip 62 is oriented to lie in concentric relation to inner annular strip 58 and annular bridge 60 extends horizontally to link inner and outer annular strips 58, 62 as suggested in FIG. 5. Strips 58, 62 and bridge 60 cooperate to form a downwardly opening annular channel 64 above an exterior surface of lid retainer 56 in the illustrated embodiment. Outer annular strip 62 includes an axially downwardly facing annular terminal end 63.

Brim 20 is configured to form several seal surfaces arranged to mate with companion portions of lid 14 as suggested in FIGS. 5 and 6. Large-diameter top portion 46 includes radially inwardly facing first annular seal surface 41. Inner annular strip 58 includes second radially inwardly facing second annular seal surface 42. Annular bridge 60 includes axially upwardly facing third annular seal surface 43. Outer annular strip 62 includes radially outwardly facing fourth annular seal surface 44.

Lid retainer 56 is a frustoconical segment in the illustrated embodiment and extends from top portion 46 to inner annular strip 58 in a radially inwardly projecting, axially outwardly extending direction as shown in FIGS. 5 and 6. Lid retainer 56 is arranged to converge toward a reference point (not shown) located along reference line 57 and in spaced-apart relation to floor 28 to position lid retainer 56 therebetween to provide an undercut 59 under inner annular strip 58 as suggested in FIGS. 5 and 6. Annular terminal end 63 of outer annular strip 62 is arranged to extend around frustoconical lid retainer 56 as suggested in FIGS. 5 and 6.

Figure 2:
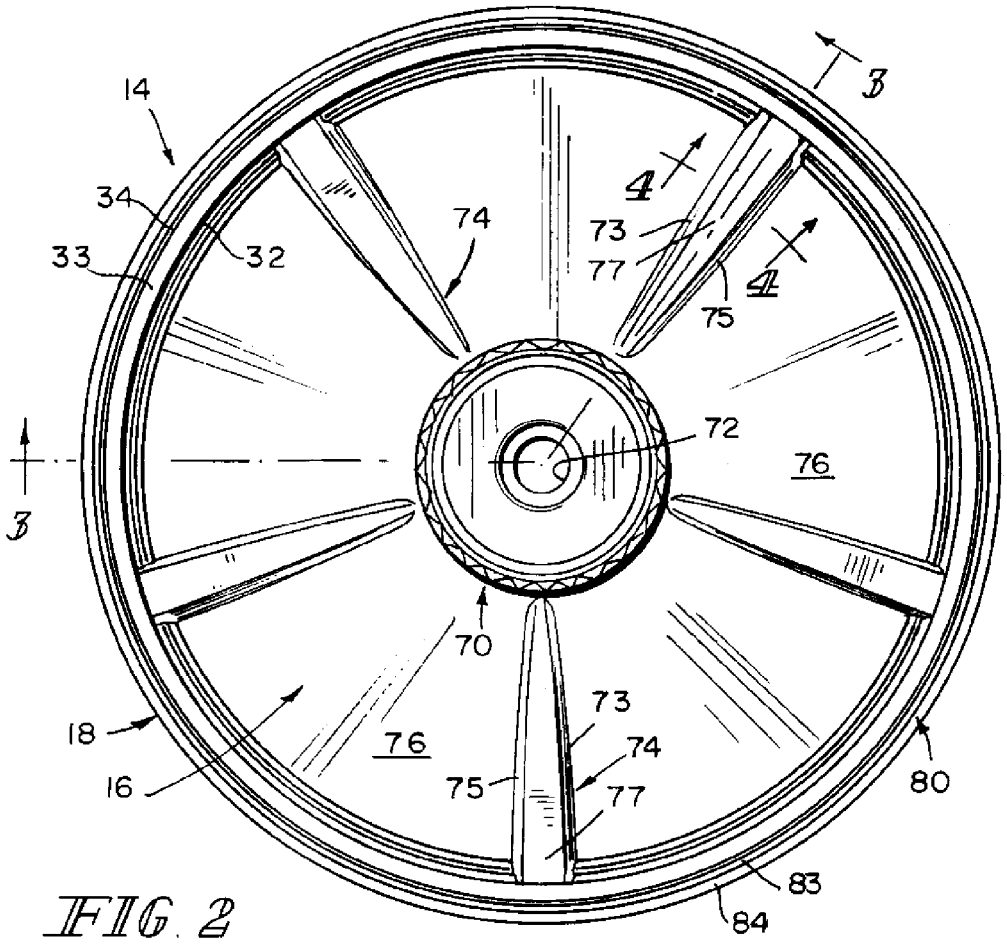
FIG. 2 is a top plan view of the lid of FIG. 1 showing a closure including a round hub providing a straw receiver, five radially extending spoke ribs terminating at the hub, and an included plate located between each pair of adjacent spoke ribs and showing a closure mount ring encircling the spoke ribs and inclined plates.
Figure 4:
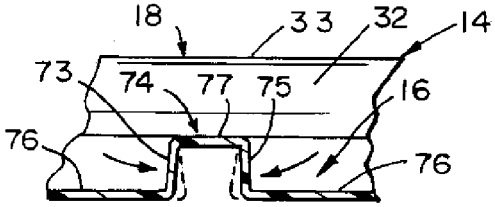
FIG. 4 is a transverse sectional view taken along line 4-4 of FIG. 2 showing one of the spoke ribs (in solid) when the lid is mounted on the cup as shown in FIG. 6 and showing deformation of that spoke rib (in phantom) of the type that would occur during mounting of the lid on the brim of the cup.

As shown in FIGS. 1 and 2, closure 16 of lid 14 includes a round hub 70 providing a straw receiver 72, five radially extending spoke ribs 74 terminating at hub 70, and an inclined plate 76 located between each pair of adjacent spoke ribs 74. In the illustrated embodiment, closure mount 18 is ring-shaped and arranged to encircle radially outermost portions of spoke ribs 74 and inclined plates 76. Each spoke rib 74 includes first and second side walls 73, 75 and a top wall 77 interconnecting side walls 73, 75 as suggested in FIGS. 2 and 4. Deformation of side walls 73, 75 of one of spoke ribs 74 during mounting of lid 14 on brim 20 of cup 12 is shown in phantom in FIG. 4.

Retainer 24 in lid 14 is defined by an annular first lid-removal blocker wall located between and arranged to interconnect first and second seal rings 31, 32. First lid-removal blocker wall 24 is arranged to engage frustoconical lid retainer 56 during movement of lid 14 in an outer direction 78 (see FIG. 6) away from floor 28 of cup 12 to block unwanted removal of lid 14 from cup 12. In the illustrated embodiment, first lid-removal blocker wall 24 has a frustoconical shape. First lid-removal blocker wall 24 is configured to diverge in direction 79 toward floor 28 of cup 12 as suggested, for example, in FIG. 6. First lid retainer 56 is arranged to lie above and in confronting relation to first lid-removal blocker wall 24 when closure mount 18 is coupled to brim 20 as suggested, for example, in FIG. 6. As suggested in FIG. 4, first seal ring 31 has a larger diameter than second seal ring 32.

Closure mount 18 further includes an annular lid-removal flange 80 located below fourth seal ring 34 and arranged to extend downwardly in an inner direction 79 opposite to outer direction 78. Retainer 26 included in lid 14 forms a part of closure mount 18 and is formed to provide a second lid-removal blocker wall. This second lid-removal blocker wall 26 is arranged to engage terminal end 63 of brim 20 during movement of lid 14 in outer direction 78 to block unwanted removal of lid 14 from cup 12.

Lid-removal flange 80 includes, in series, first, second, third, and fourth annular segments 81, 82, 83, and 84 as shown in detail in FIGS. 5 and 6. Second lid-removal blocker wall 26 has a frustoconical shape and is arranged to interconnect first annular segment 81 of lid-removal flange 80 and fourth seal ring 34 of closure mount 18. Each of the segments have frustoconical shapes of various slopes. Second lid-removal blocker wall 26 is configured to converge in direction 79 toward floor 28 of cup 12 as suggested, for example, in FIG. 6.

First annular segment 81 is arranged to surround first seal ring 31 to define an annular channel 85 therebetween. When lid 14 is mounted on brim 20 of cup 12, radially inwardly facing first annular seal surface 41 is located in annular channel 85 as shown, for example, in FIG. 6.

Referring to the illustration of closure mount 18 in FIG. 5, fourth seal ring 34 is aligned in concentric relation with second seal ring 32. The diameter of fourth seal ring 34 is greater than the diameters of first and second seal rings 31, 32. Closure mount 18 also includes an annular quarter round-shaped inner rim 86 interconnecting second and third seal rings 32, 33 and an annular quarter round-shaped outer rim 88 interconnecting third and fourth seal rings 33, 34 as suggested in FIG. 5. Second, third, and fourth seal rings 32, 33, 34 cooperate to define an annular chamber 89 communicating with annular channel 85 and receiving brim 20 therein when lid 14 is mounted on cup 12 as suggested in FIG. 6.

Figure 3:
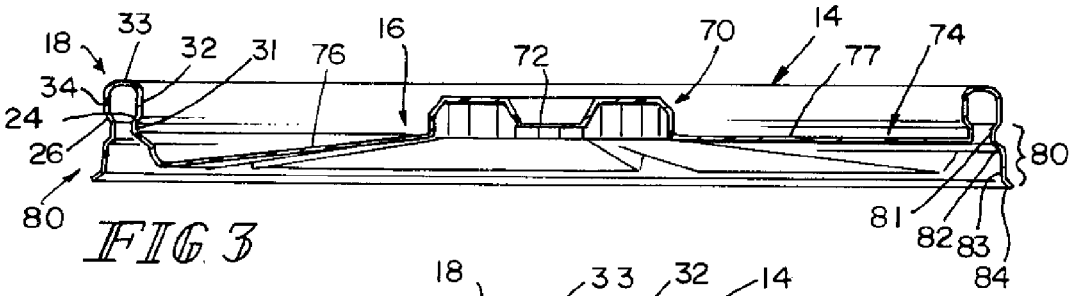
FIG. 3 is a sectional view of the lid taken along line 3-3 of FIG. 2 showing the configuration of a downwardly opening annular brim receiver defined by the closure mount ring and sized to receive an annular brim of the cup therein as suggested in FIGS. 5 and 6.

Closure 16 includes a peripheral portion comprising outer frustoconical wall 90 appended to first seal ring 31, inner frustoconical wall 91 appended to inclined plates 76, and middle frustoconical wall 92 arranged to interconnect outer and inner frustoconical walls 90, 91 as shown in FIGS. 1, 3, and 5. These walls 90-92 cooperate to support inclined plates 76 as suggested in the drawings.

The slope of inclined plates 76 provided in lid 14 increases once lid 14 is mounted on cup 12. Owing, in part, to configuration of walls 90-92, a first of inclined plates 76 has a first slope (defined by first acute angle 93) with respect to a horizontal reference plane 94 before closure mount 18 is mounted on brim 20 of cup 12 as suggested in FIG. 5. That inclined plate 76 is moved to assume a steeper second slope (defined by second acute angle 95) with respect to horizontal reference plane 94 upon coupling of closure mount 18 on brim 20 as suggested in FIG. 6. As lid 14 is mounted on brim 20 of cup 12, dimension 100 between radially outwardly facing surfaces of first seal ring 31 and first annular segment 81 will increase as suggested by greater dimension 101 owing, in part, to dimension 102 between radially outwardly facing fourth annular seal surface 44 and radially outwardly facing surface of top portion 46 since dimension 102 is greater than dimension 100.

Lid 114 shown, for example, in FIGS. 7-12, incorporated many of the features associated with lid 14 shown, for example, in FIGS. 1-6. Retainers 124, 126 included in lid 114 are arranged to engage portions of cup 112 to block unwanted removal of lid 114 from cup 112 as suggested in FIG. 12. Four seal rings 131, 132, 133, and 134 are provided on lid 114 to engage companion annular seal surfaces 141, 142, 143, and 144 on cup 112 to establish four liquid flow barriers arranged in series near and on brim 120 of cup 112 to block unwanted discharge of liquid from a liquid reservoir chamber 122 in cup 112 while lid 114 is in place on cup 112 as suggested in FIG. 12.

Figure 12:
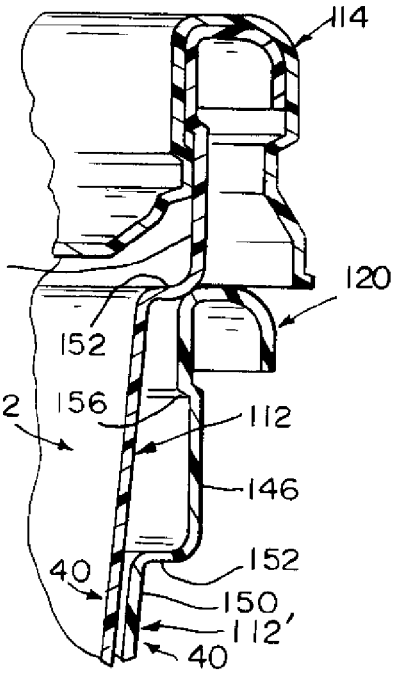
FIG. 12 is a partial sectional view showing a lid of the type shown in FIGS. 7-11 mounted on a first cup that is nested in an underlying second cup.

As shown, for example, in FIG. 12, cup 112 includes brim 120 and a side wall 140 extending downwardly from brim 120. Side wall 140 is formed to include a large-diameter top portion 146 appended to brim 120, a body portion 150 located under top portion 146, and an annular transitional portion 152 interconnecting top portion 146 and body portion 150. Brim 120 also includes a lid retainer 156 as suggested in FIG. 12.

Closure 116 of lid 114 includes a round hub 170 providing a straw receiver 172 and five radically extending spoke ribs 174 terminating at hub 170. Closure 116 also includes an inclined plate 176 located between each pair of adjacent spoke ribs 174. Lid 114 also includes a lid-removal flange 180 as suggested in FIGS. 8, 9, and 12

Figure 13:
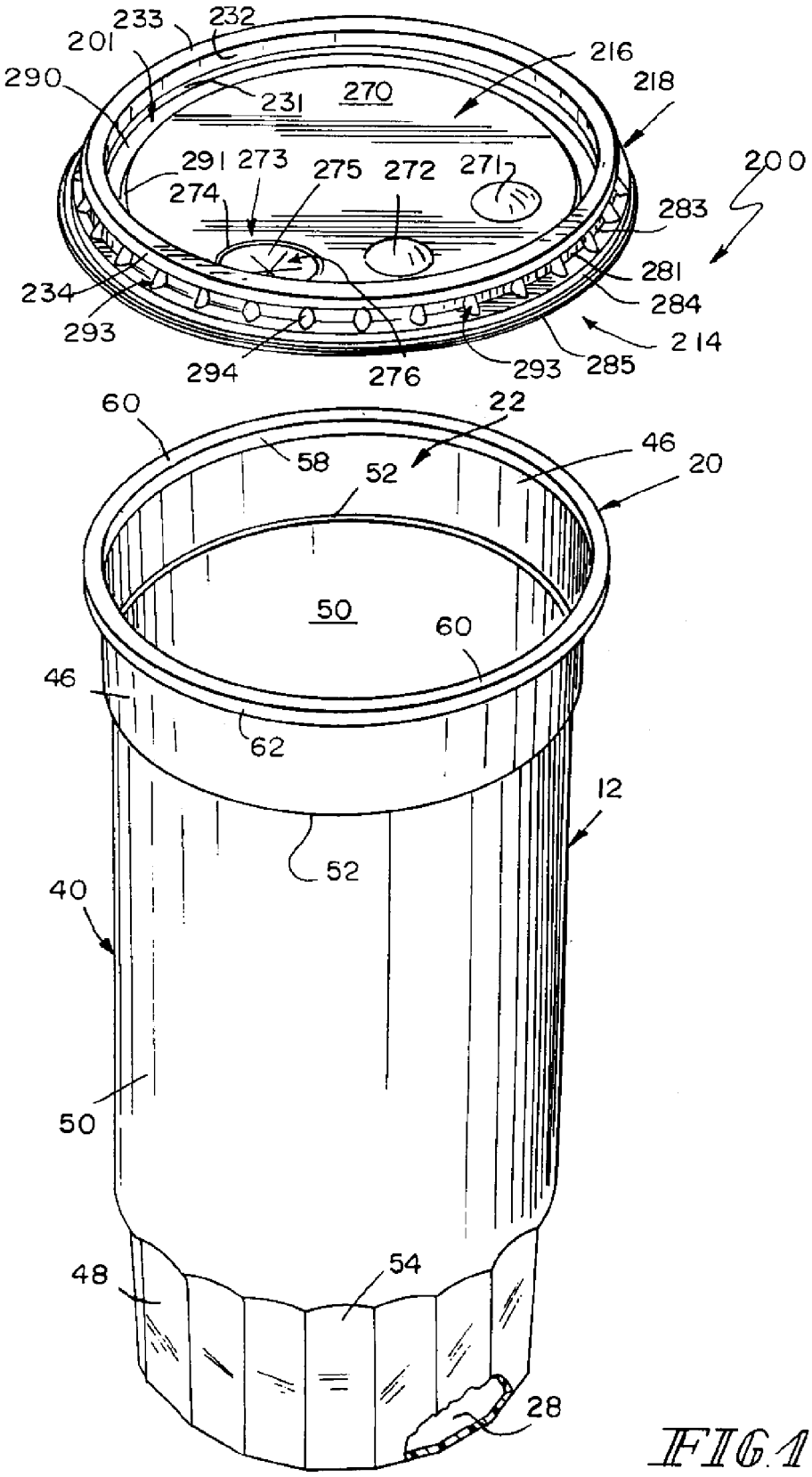
FIG. 13 is a perspective view of a lid in accordance with a third embodiment of the present disclosure and a cup before the lid is mounted on the cup.

A liquid container 200 includes a cup 12 and a lid 214 in accordance with a third embodiment of the present disclosure as shown in FIG. 13. Lid 214 includes a closure 216 and a fluted closure mount 218 configured to be mounted on a brim 20 of cup 12 to arrange closure 216 to close an opening into a liquid reservoir chamber 22 formed in cup 12 as suggested in FIG. 17.

Figure 16:
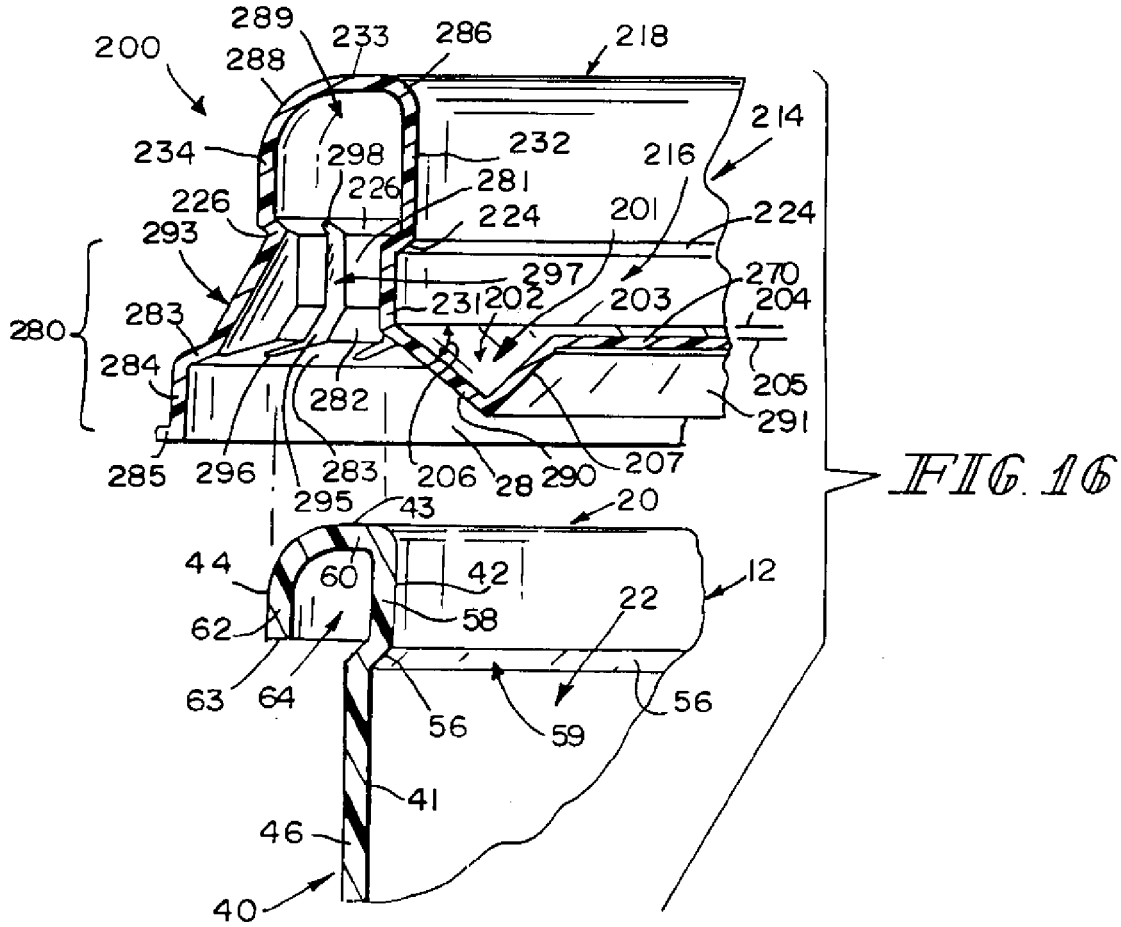
FIG. 16 is an enlarged sectional view of portions of the lid and cup of FIG. 13 before the lid is mounted on the cup.
Figure 17:
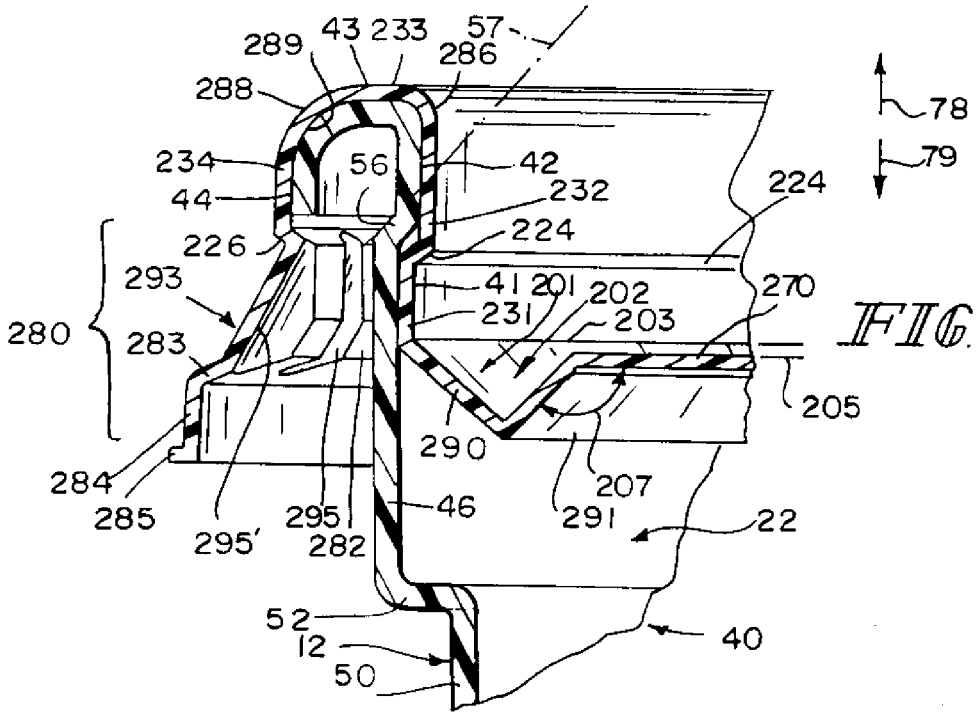
FIG. 17 is a view similar to FIG. 16 after the lid is mounted on the cup showing formation of a series of liquid flow barriers to retain liquid in a reservoir chamber formed in the cup owing to sealing engagement between the closure mount ring of the lid and both of a side wall and the brim of the cup, also showing retention of the lid on the cup owing, in part, to engagement of a portion of the lid in an "undercut" formed on an interior surface of the cup at a junction between the side wall and the brim of the cup, and further showing that the lid includes a fluted closure mount ring including an annular lid-removal flange arranged to extend downwardly from the brim of the cup and formed to include a series of circumferentially spaced-apart radially inwardly opening channels facing toward an exterior surface of the side wall of the cup.

In illustrative embodiments, retainers 224, 226 included in lid 214 are arranged to engage portions of cup 12 to block unwanted removal of lid 214 from cup 12 as suggested in FIGS. 16 and 17. Also in illustrative embodiments, four seal rings 231, 232, 233, and 234 are provided on lid 214 to engage companion annular seal surfaces 41, 42, 43, and 44 on cup 12 to establish four liquid flow barriers arranged in series near and on brim 20 to block unwanted discharge of liquid from liquid reservoir chamber 22 while lid 214 is in place on cup 12 as suggested in FIGS. 16 and 17.

As shown in FIG. 13, cup 12 includes brim 20, a floor 28, and a side wall 40 extending from brim 20 to floor 28. Side wall 40 is formed to include a large-diameter top portion 46 appended to brim 20, a small-diameter bottom portion 48, and a body portion 50 located between top and bottom portions 46, 48 as shown in FIG. 13. Side wall 40 also includes an annular top transitional portion 52 interconnecting top portion 46 and body portion 50 as shown, for example, in FIGS. 16 and 17. Side wall 40 also includes a "scalloped" annular bottom transitional portion 54 interconnecting body portion 50 and bottom portion 48 as suggested in FIG. 13.

As shown, for example, in FIG. 16, brim 20 includes, in series, a lid retainer 56, an inner annular strip 58, an annular bridge 60, and an outer annular strip 62. Lid retainer 56 is rooted to an upper portion of top portion 46 to anchor brim 20 to top portion 46. Outer annular strip 62 is oriented to lie in concentric relation to inner annular strip 58 and annular bridge 60 extends horizontally to link inner and outer annular strips 58, 62 as suggested in FIG. 13. Strips 58, 62 and bridge 60 cooperate to form a downwardly opening annular channel 64 above an exterior surface of lid retainer 56 in the illustrated embodiment. Outer annular strip 62 includes an axially downwardly facing annular terminal end 63.

Brim 20 is configured to form several seal surfaces arranged to mate with companion portions of lid 214 as suggested in FIGS. 16 and 17. Large-diameter top portion 46 includes radially inwardly facing first annular seal surface 41. Inner annular strip 58 includes second radially inwardly facing second annular seal surface 42. Annular bridge 60 includes axially upwardly facing third annular seal surface 43. Outer annular strip 62 includes radially outwardly facing fourth annular seal surface 44.

Lid retainer 56 is a frustoconical segment in the illustrated embodiment and extends from top portion 46 to inner annular strip 58 in a radially inwardly projecting, axially outwardly extending direction as shown in FIGS. 16 and 17. Lid retainer 56 is arranged to converge toward a reference point (not shown) located along reference line 57 and in spaced-apart relation to floor 28 to position lid retainer 56 therebetween to provide an undercut 59 under inner annular strip 58 as suggested in FIGS. 16 and 17. Annular terminal end 63 of outer annular strip 62 is arranged to extend around frustoconical lid retainer 56 as suggested in FIGS. 16 and 17.

Figure 14:
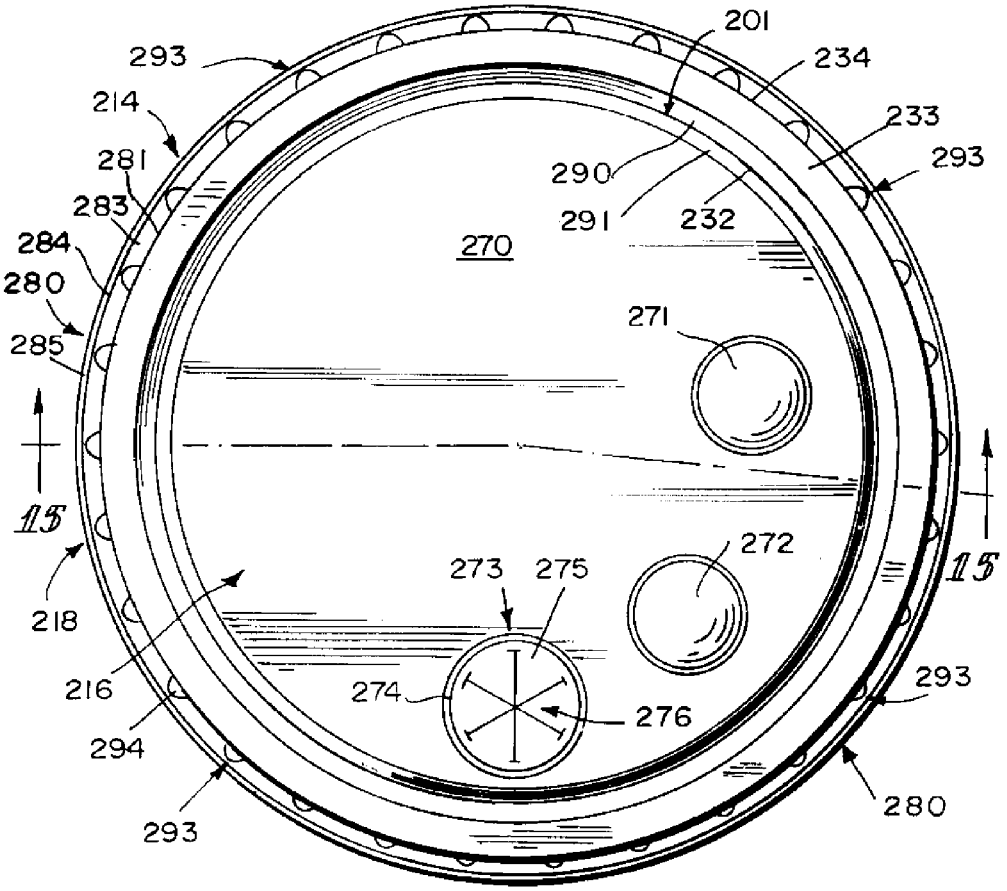
FIG. 14 is a top plan view of the lid of FIG. 13 showing a closure including a round plate formed to include a straw receiver and two separate deformable drink-identification domes and showing a closure mount ring encircling the round plate.

As shown in FIGS. 13 and 14, closure 216 of lid 214 includes a round plate 270 formed to include deformable first and second product-identification domes 271, 272 and a liquid-dispenser zone 273. Liquid-dispenser zone 273 includes a round perimeter wall 274 bounding a land 275 formed to include a straw receiver 276. In the illustrated embodiment, closure mount 18 is ring-shaped and arranged to encircle round plate 270.

Retainer 224 in lid 214 is defined by an annular first lid-removal blocker wall located between and arranged to interconnect first and second seal rings 231, 232. First lid-removal blocker wall 224 is arranged to engage frustoconical lid retainer 56 during movement of lid 214 in an outer direction 78 (see FIG. 17) away from floor 28 of cup 12 to block unwanted removal of lid 214 from cup 12. In the illustrated embodiment, first lid-removal blocker wall 224 has a frustoconical shape. First lid-removal blocker wall 224 is configured to diverge in direction 79 toward floor 28 of cup 12 as suggested, for example, in FIG. 17. First lid retainer 56 is arranged to lie above and in confronting relation to first lid-removal blocker wall 224 when closure mount 218 is coupled to brim 20 as suggested, for example, in FIG. 17. As suggested in FIG. 15, first seal ring 231 has a larger diameter than second seal ring 232.

Closure mount 218 further includes an annular lid-removal flange 280 located below fourth seal ring 234 and arranged to extend downwardly in an inner direction 79 opposite to outer direction 78. Closure mount 218 is fluted in the embodiment shown in FIGS. 13-20 owing to the formation of radially inwardly facing grooves 297 in protuberances 293 provided in annular lid-removal flange 280 as shown, for example, in FIGS. 16-19.

Retainer 226 included in lid 214 forms a part of fluted closure mount 218 and is formed to provide a second lid-removal blocker wall. This second lid-removal blocker wall 226 is arranged to engage terminal end 63 of brim 20 during movement of lid 214 in outer direction 78 to block unwanted removal of lid 214 from cup 12. In the illustrated embodiment, second lid-removal blocker wall 226 has a frustoconical shape.

Lid-removal flange 280 includes, in series, first, second, third, fourth, and fifth annular segments 281, 282, 283, 284, and 285 as shown in detail in FIGS. 15-20. Second lid-removal blocker wall 226 has a frustoconical shape and is arranged to interconnect first annular segment 281 of lid-removal flange 280 and fourth seal ring 234 of closure mount 218. Each of the segments have frustoconical shapes of various slopes. Second lid-removal blocker wall 226 is configured to converge in direction 79 toward floor 28 of cup 12 as suggested, for example, in FIG. 17.

First annular segment 281 is arranged to surround first seal ring 231 to define an annular channel therebetween. When lid 214 is mounted on brim 20 of cup 12, radially inwardly facing first annular seal surface 241 is located in this annular channel as shown, for example, in FIG. 17.

Referring to the illustration of closure mount 218 in FIG. 16, fourth seal ring 234 is aligned in concentric relation with second seal ring 232. The diameter of fourth seal ring 234 is greater than the diameters of first and second seal rings 231, 232. Closure mount 218 also includes an annular quarter round-shaped inner rim 286 interconnecting second and third seal rings 232, 233 and an annular quarter round-shaped outer rim 288 interconnecting third and fourth seal rings 233, 234 as suggested in FIG. 16. Second, third, and fourth seal rings 232, 233, 234 cooperate to define an annular chamber 289 communicating with the annular channel defined between first annular segment 281 and first seal ring 231 and receiving brim 20 therein when lid 214 is mounted on cup 12 as suggested in FIGS. 16 and 17.

Figure 15:
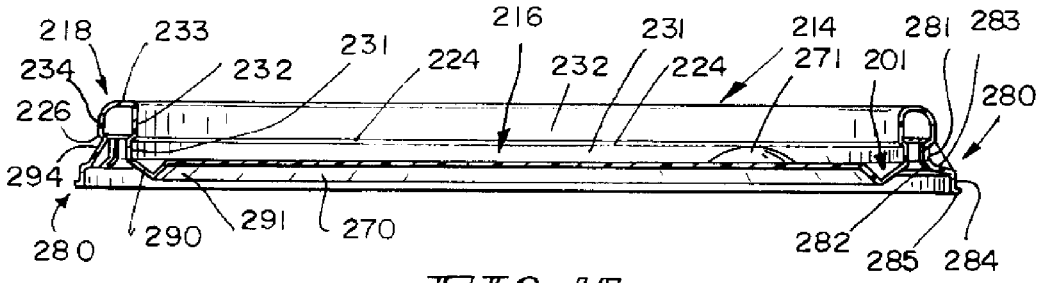
FIG. 15 is a sectional view of the lid taken along line 15-15 of FIG. 14 showing the configuration of a downwardly opening annular brim receiver defined by the closure mount ring and sized to receive an annular brim of the cup therein as suggested in FIGS. 16 and 17.

Closure 216 includes a peripheral portion 201 comprising outer frustoconical wall 290 appended to first seal ring 231 and inner frustoconical wall 291 appended to round plate 270 and surrounded by outer frustoconical wall 290 as shown in FIGS. 13, 15, and 16. These walls 290 and 291 cooperate to support round plate 270 as suggested in the drawings. Peripheral portion 201 has a V-shaped cross section as shown, for example, in FIGS. 16 and 17 and surrounds round plate 270 and mates with first seal ring 231. Inner frustoconical wall 291 cooperates with outer frustoconical wall 290 to define a channel 202 having a top opening facing away from floor 28 of cup 12 as suggested in FIGS. 13, 16, and 17.

Outer frustoconical wall 290 mates with first seal ring 231 at a circular edge 203 lying in a first plane 204 and round plate 270 lies in a second plane 205 located between first plane 204 and floor 28 of cup 12 as suggested in FIG. 17. Outer frustoconical wall 290 cooperates with first plane 204 to define an acute included angle 206 therebetween of about 40° as suggested in FIG. 17. Inner frustoconical wall 291 cooperates with round plate 270 to define an obtuse included angle 207 therebetween of about 137°.

Figure 20:
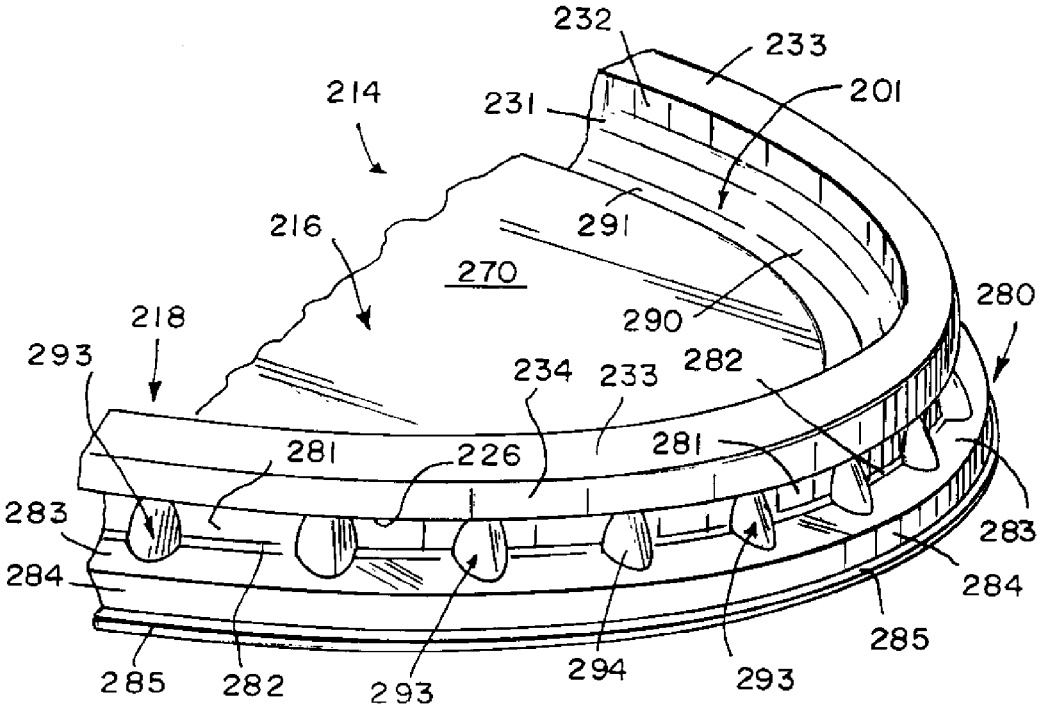
FIG. 20 is an enlarged perspective view of a portion of the lid of FIGS. 13-20 showing a series of radially outwardly projecting and circumferentially spaced-apart protuberances formed in the annular lid-removal flange of the fluted closure mount ring wherein each of the protuberances has a radially inwardly facing interior surface defining one of the channels included in the annular lid-removal flange.

As shown best in FIGS. 13, 14, and 20, fluted closure mount 218 of lid 214 further includes a series of circumferentially spaced-apart protuberances 293. Each protuberance 293 is arranged to extend upwardly from third annular segment 283 to annular retainer 226. In an illustrative embodiment, each protuberance 293 is characterized by a convex, rounded outer surface 294 that is arranged to face away from top portion 46 of side wall 40 when lid 214 is mounted on brim 20 of cup 12 and a concave, rounded inner surface 295 that is arranged to face toward top portion 46 when lid 214 is mounted on brim 20.

Figure 18:
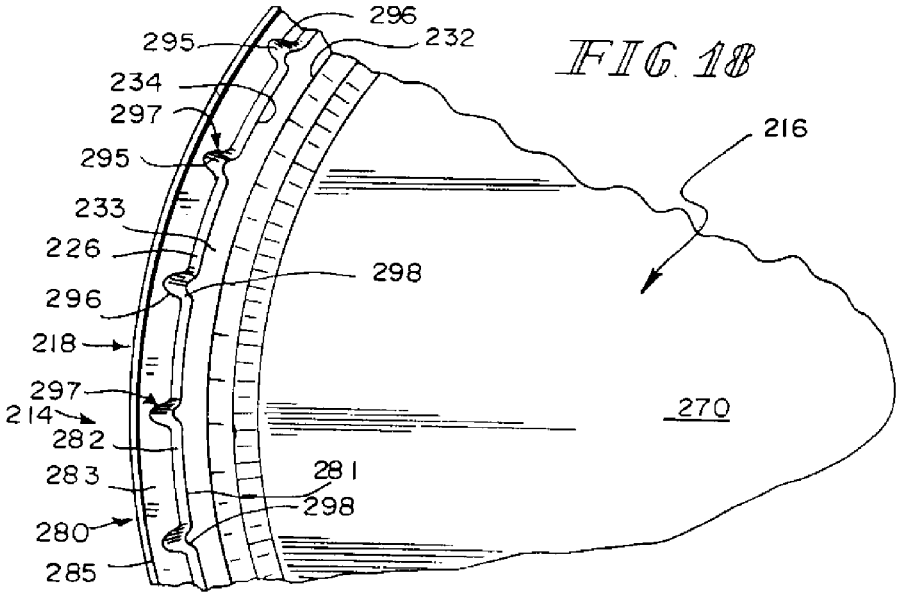
FIG. 18 is an enlarged partial bottom view of the lid of FIGS. 13-17 showing five of the circumferentially spaced-apart channels formed in the annular lid-removal flange.
Figure 19:
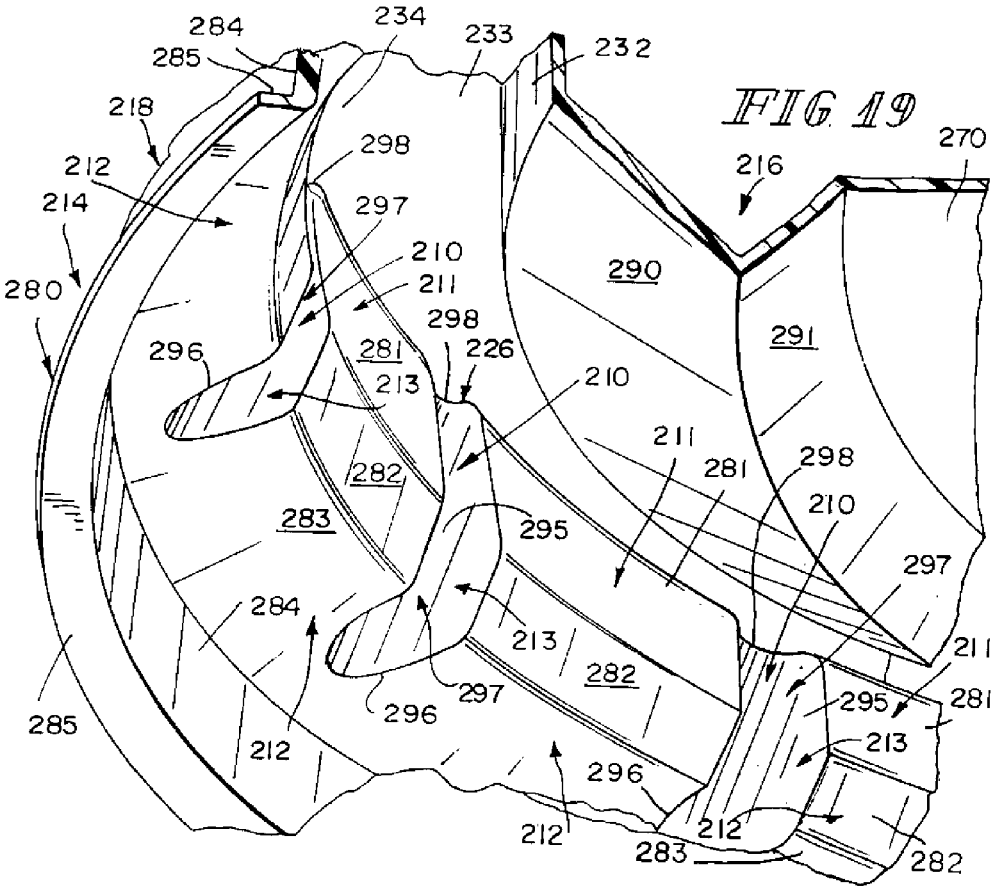
FIG. 19 is a highly enlarged, fragmented, perspective view of a portion of the underside of the lid of FIG. 18 showing three of the channels formed in the annular lid-removal flange.

As shown best in FIGS. 18 and 19, third annular segment 283 in closure mount 218 includes a U-shaped edge 296 associated with each protuberance 293 and formed to define a bottom opening into an interior region or groove 297 bounded by concave, rounded inner surface 295 of a companion protuberance 293. Likewise, second lid-removal blocker wall 226 is formed to include a more shallow U-shaped edge 298 associated with each protuberance 293 and formed to define a top opening into the companion interior region 297. As shown, for example, in FIG. 19, first and second annular segments 281, 282 are interrupted by interior regions 297 of protuberances 293. In the illustrated embodiment, closure mount 218 is fluted in that it is marked by a series of radially inwardly facing grooves 297 defined by concave, rounded inner surfaces 295 of protuberances 293.

Lid-removal flange 280 includes, in series, a first annular segment 281 coupled to lid-removal blocker wall 226, a second annular segment 282, and a third annular segment 283 consistent with a first perspective of lid-removal flange 280, the first and second annular segments 281, 282 being formed to include protuberances 293. Each protuberance 293 includes an upper end mating with second lid-removal blocker wall 226 and a lower end mating with third annular segment 283 as shown best in FIGS. 15 and 20. Lid-removal blocker wall 280 includes a U-shaped edge 298 associated with the upper end of each protuberance 293 and formed to define a top opening into the radially inwardly facing groove 297 formed in said each protuberance 293 as suggested in FIGS. 16-20. Third annular segment 283 includes a U-shaped edge 296 associated with the lower end of each protuberance 293 and formed to define a bottom opening into the radially inwardly facing groove 297 formed in said each protuberance 293.

Consistent with a second perspective of lid-removal flange 280, first annular segment 281 includes a series of spaced-apart first arcuate elements 211 arranged in a ring-shaped formation to define a first protuberance-receiving space 210 between each pair of adjacent first arcuate elements 211. Second annular segment 282 includes a series of spaced-apart second arcuate elements 212 arranged in a ring-shaped formation to define a second protuberance-receiving space 213 between each pair of adjacent second arcuate elements 212. Each protuberance 293 is located in an aligned pair of companion first and second protuberance-receiving spaces 210, 213 and coupled to each of the first and second arcuate elements 211, 212 cooperating to define said aligned pair of companion first and second protuberance-receiving spaces 210, 213. First annular segment 281 has a cylindrical shape, second annular segment 282 has a first frustoconical shape characterized by a steep slope, and third annular segment 283 has a second frustoconical shape characterized by a slope that is less steep than the steep slope of the first frustoconical shape of second annular segment 282 as suggested in FIG. 15. Lid-removal blocker wall 226 has a third frustoconical shape.

Fourth seal ring 284 is arranged to extend in a vertical direction when fluted closure mount ring 218 is coupled to brim 20 of cup 12 as shown in FIG. 17. At least a portion 295' of concave, rounded inner surface 295 of protuberance 293 is inclined to slope in a downwardly and radially outwardly extending direction relative to fourth seal ring 284 as also shown in FIG. 17. At least a portion 294' of the concave, rounded outer surface 294 is inclined to slope in a downwardly and radially outwardly extending direction relative to fourth seal ring 284 as shown in FIG. 17.

Figure 21:
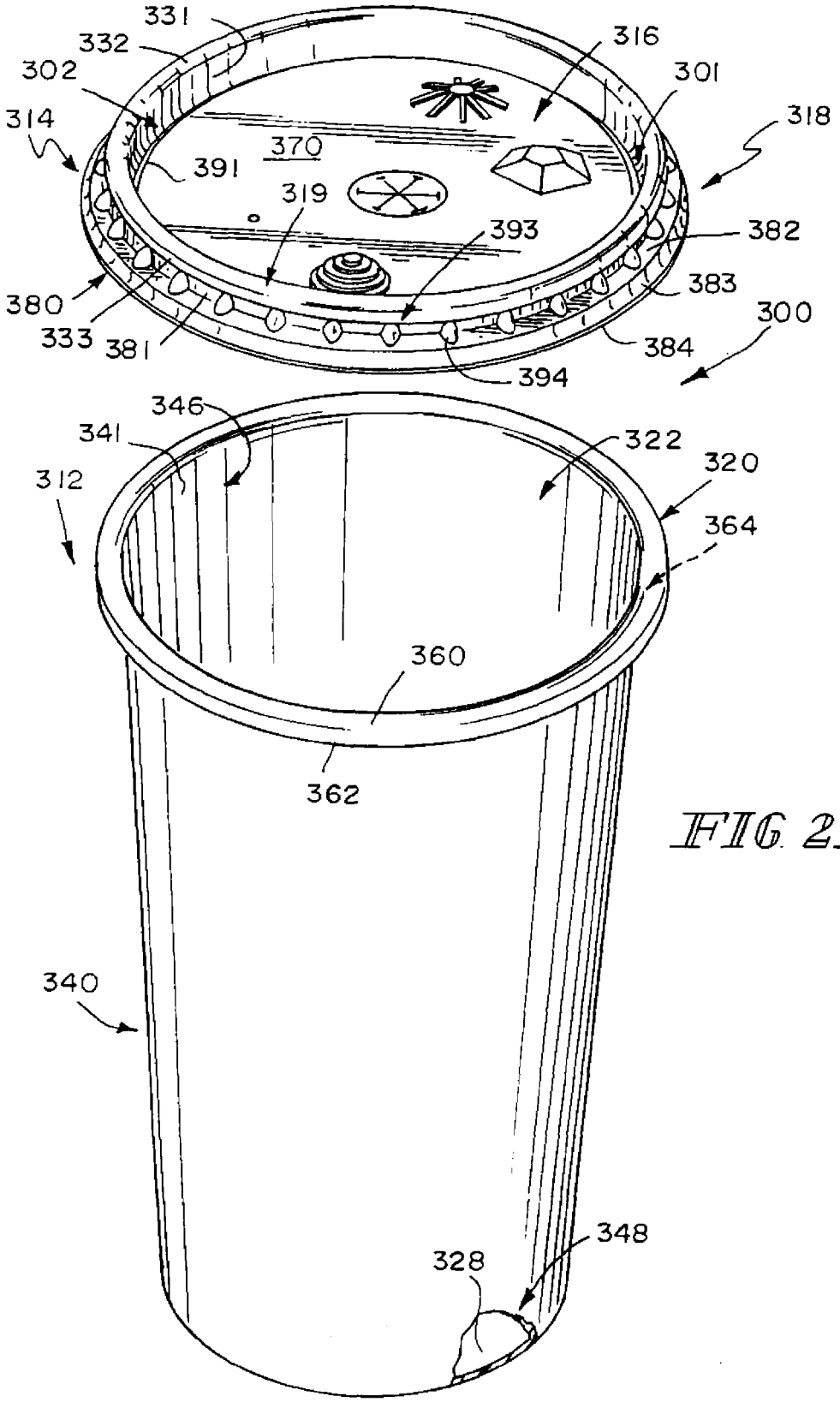
FIG. 21 is a perspective view of a lid in accordance with a fourth embodiment of the present disclosure and a paper cup before the lid is mounted on the paper cup.

A liquid container 300 includes a paper cup 312 and a lid 314 in accordance with a fourth embodiment of the present disclosure as shown, for example, in FIG. 21. Lid 314 includes a "bowl-shaped" closure 316 and a brim mount 318 configured to be mounted on a brim 320 of paper cup 312 to arrange closure 316 to close an opening into a liquid reservoir chamber 322 formed in paper cup 312 as suggested in FIGS. 25 and 26.

Figure 24:
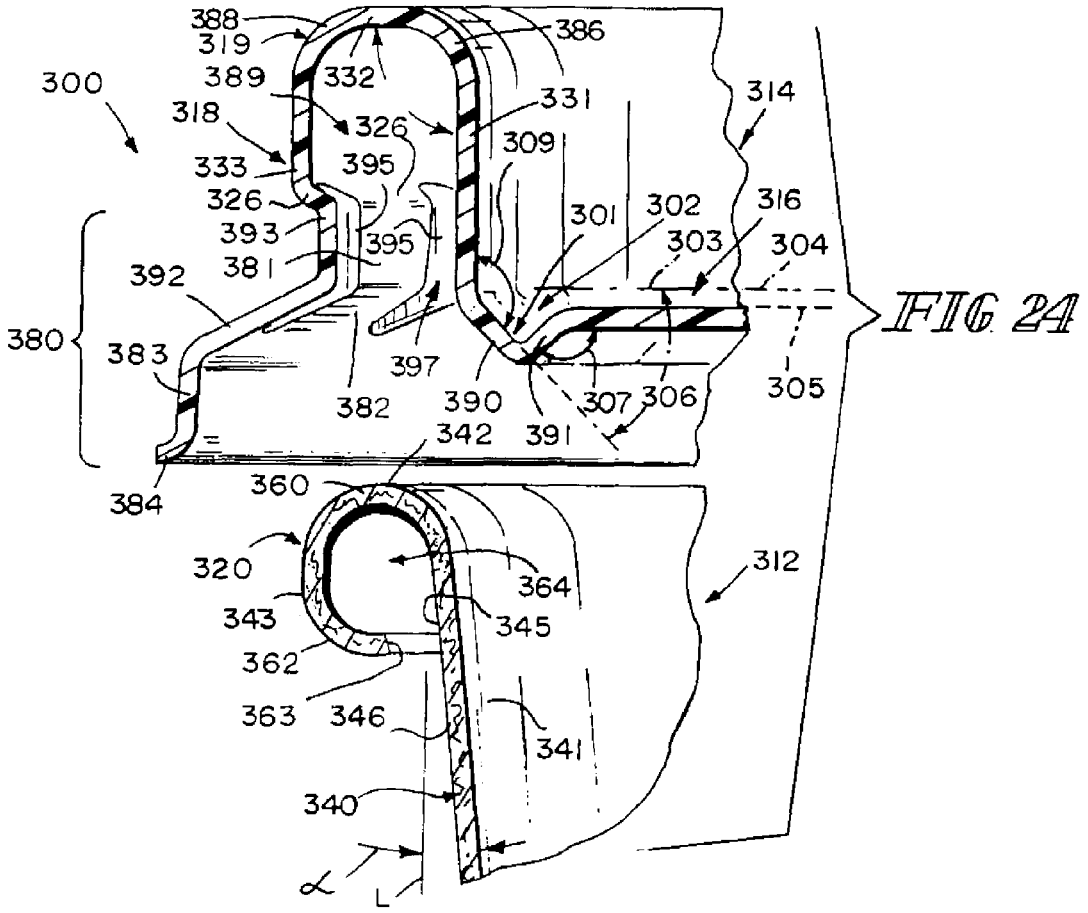
FIG. 24 is an enlarged sectional view of portions of the lid and paper cup of FIG. 20 before the lid is mounted on the paper cup.

As shown in FIG. 21, paper cup 312 includes brim 320, a floor 328, and a sloping side wall 340 extending from brim 320 to floor 328. Side wall 340 has a frustoconical shape in the illustrated embodiment and is oriented to slope at an angle of about 7° with respect to vertical line "L" as shown in FIG. 24. An upper portion 346 of side wall 340 is appended to brim 320 and a lower portion 348 of side wall 340 is appended to floor 328. Side wall 340 includes a radially inwardly facing frustoconical first annular seal surface 341 as shown, for example, in FIGS. 21, 24, 25, and 29.

Figure 29:
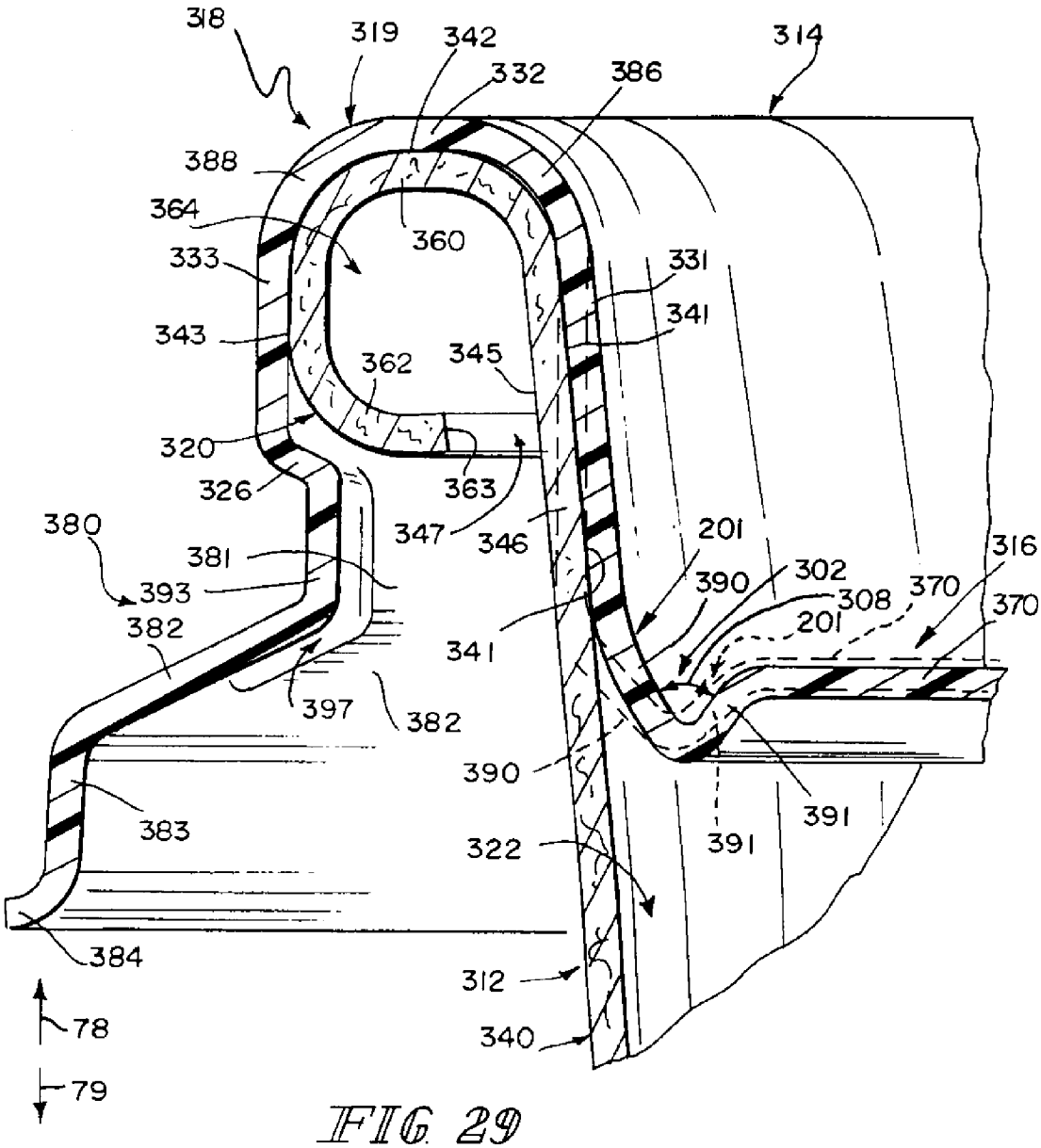
FIG. 29 is an enlarged sectional view similar to FIG. 24 showing that the lid includes a "bowl-shaped" closure comprising the round plate, a first seal ring adjacent to a sloping side wall of the paper cup, and a "force-generator" portion arranged to interconnect a lower portion of the first seal ring and an outer portion of the round plate and configured to apply a radially outwardly directed force to the first seal ring and showing the "uncompressed" shape of the bowl-shaped closure (in phantom) when the lid is separated from the paper cup as shown in FIG. 24 and also showing the "compressed" shape of the bowl-shaped closure (in solid) when the lid is mounted on the paper cup and the force-generator portion located between the vertical first seal ring and the horizontal round plate is compressed by engagement with the side wall of the paper cup to generate the radially outwardly directed force that is applied to the first seal ring.

As shown, for example, in FIGS. 24 and 29, brim 320 includes a "quarter-round" lower annular portion 362 and a "half-round" upper annular portion 360. Half-round upper annular portion 360 is arranged to interconnect upper portion 346 of side wall 340 and quarter-round lower annular portion 362 of brim 320 as suggested in FIGS. 24 and 29. Portions 346, 360, and 362 of brim 320 cooperate to form a downwardly opening annular channel 364 providing an interior region of brim 320 as suggested in FIGS. 24 and 29. A radially inwardly facing terminal end 363 of quarter-round lower annular portion 362 cooperates with an exterior surface 345 of side wall 340 to form an annular inlet 347 located therebetween and arranged to open into annular channel 364 as suggested in FIGS. 24 and 29. In the illustrated embodiment, terminal end 363 has a frustoconical shape.

Figure 25:
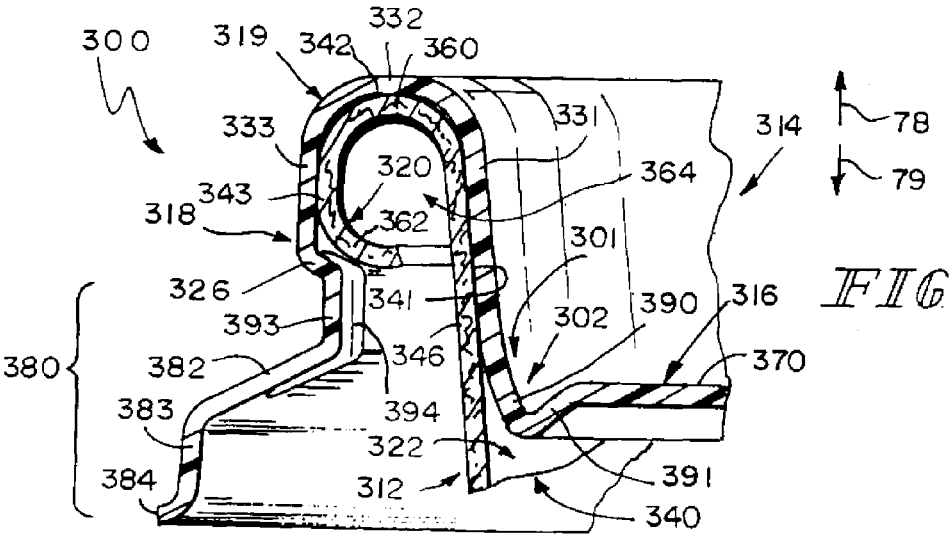
FIG. 25 is a view similar to FIG. 24 after the lid is mounted on the paper cup showing formation of a series of "inner, upper, and outer" liquid flow barriers to retain liquid in a liquid reservoir chamber formed in the paper cup owing to sealing engagement between the bowl-shaped closure of the lid and a side wall of the paper cup and also between the brim mount of the lid and the brim of the paper cup.

Paper cup 312 is configured to form several seal surfaces arranged to mate with companion portions of lid 314 as suggested in FIGS. 25 and 29. Upper portion 346 of side wall 340 includes radially inwardly facing frustoconical first annular seal surface 341. Half-round upper annular portion 360 of brim 320 includes an axially upwardly facing second annular seal surface 342. Quarter-round lower annular portion 362 of brim 320 includes a radially outwardly facing annular seal surface 343. Lid 314 includes three seal rings 331, 332, and 333 that are configured and arranged to engage companion annular seal surfaces 341, 342, and 343 provided on paper cup 312 to establish three liquid flow barriers arranged in series near and on brim 320 to block unwanted discharge of liquid from liquid reservoir chamber 322 while lid 314 is in place on paper cup 312 as suggested in FIGS. 25 and 29.

Brim mount 318 of lid 314 includes a rim 319, a lid-removal blocker wall 326, and an annular lid-removal flange 380 as shown, for example, in FIGS. 24, 25, and 29. Rim 319 is arranged to mate with brim 320 when lid 314 is mounted on paper cup 312 as shown, for example, in FIGS. 25 and 29. Lid-removal blocker wall 326 interconnects rim 319 and annular lid-removal flange 380 as shown in FIGS. 24, 25, and 29.

Rim 319 of brim mount 318 is configured to mate with brim 320 of paper cup 312 whenever lid 314 is mounted on paper cup 312 as shown, for example, in FIGS. 25 and 29. Rim 319 includes seal rings 332 and 333 in an illustrative embodiment as shown in FIGS. 24, 25, and 29.

Lid-removal blocker wall 326 of brim mount 318 is configured and arranged to engage portions of brim 320 of paper cup 312 to block unwanted removal of lid 314 from paper cup 312 as suggested in FIGS. 25 and 29. Lid-removal blacker wall 326 is arranged to engage a lid retainer defined by an outwardly facing surface of quarter-round lower annular portion 362 of brim 320 during movement of lid 314 in outer direction 78 to block removal of lid 314 from paper cup 312. In the illustrated embodiment, lid-removal blocker wall 326 has a frustoconical shape.

Annular lid-removal flange 380 of brim mount 318 is located below third seal ring 333 and arranged to extend downwardly in an inner direction 79 as suggested in FIGS. 24 and 29. Brim mount 318 is fluted in the embodiment shown in FIGS. 21-29 owing to the formation of radially inwardly facing grooves 397 in protuberances 393 provided in annular lid-removal flange 380 as shown, for example, in FIGS. 24-27.

Annular lid-removal flange 380 includes, in series, first, second, third, and fourth annular segments 381, 382, 383, and 384 as shown in detail in FIGS. 24-29. Lid-removal blocker wall 326 is arranged to interconnect first annular segment 281 of lid-removal flange 380 and third seal ring 333 of rim 319. Each of the segments has a frustoconical shape and the frustoconical segments have various slopes. Lid-removal blocker wall 326 has a frustoconical shape and is configured to converge in direction 79 toward floor 328 of paper cup 312 as suggested, for example, in FIG. 25.

First annular segment 381 of lid-removal flange 380 is arranged to surround first seal ring 331 of bowl-shaped closure 316 to define an annular channel therebetween as suggested in FIG. 24. When lid 314 is mounted on brim 320 of paper cup 312, radially inwardly facing first annular seal surface 341 on upper portion 346 of side wall 340 is located in this annular channel as shown, for example, in FIGS. 24 and 29. As suggested in FIG. 24, first annular segment 381 is arranged to lie normally in substantially uniformly spaced-apart concentric relation to first seal ring 331 when lid 314 is separated from paper cup 312.

Referring to the illustration of lid 314 in FIG. 24, normally, when lid 314 is separated from paper cup 312, third seal ring 333 of rim 319 is aligned in concentric relation with first seal ring 331 of bowl-shaped closure 316 of rim 316. The diameter of third seal ring 333 is greater than the diameter of first seal ring 331. Rim 319 also includes an annular quarter round-shaped inner rim portion 386 interconnecting first and second seal rings 331 and 332 and an annular quarter round-shaped outer rim portion 388 interconnecting second and third seal rings 332 and 333 as suggested in FIG. 24. First, second, and third seal rings 331, 332, 333 cooperate with inner and outer rims 386, 388 to define an annular chamber 389 communicating with the annular channel defined between first annular segment 381 and first seal ring 331 and receiving brim 320 therein when lid 314 is mounted on paper cup 312 as suggested in FIGS. 24, 25, and 29.

Figure 22:
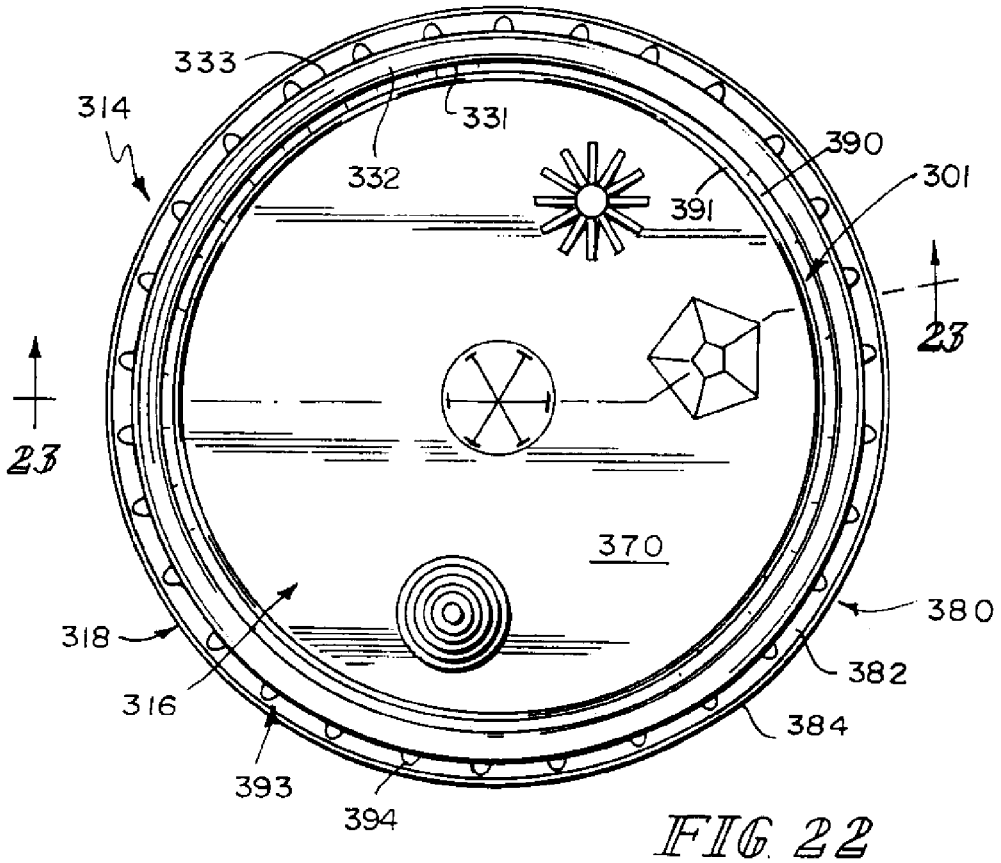
FIG. 22 is an enlarged top plan view of the lid of FIG. 21 showing a closure including a cover defined by a round plate and formed to include a straw receiver and three other features and a brim mount encircling the round plate.
Figure 23:
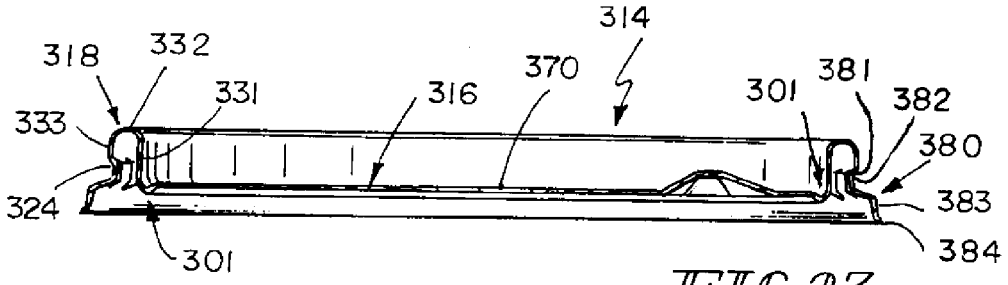
FIG. 23 is a sectional view of the lid taken along line 23-23 of FIG. 22 showing configuration of a downwardly opening annular brim receiver defined by the closure and the surrounding brim mount and sized to receive an annular brim of the paper cup therein as suggested in FIGS. 24 and 25 and showing the "shallow" bowl shape of the closure.

Closure 316 of lid 314 includes first seal ring 331, a cover 370, and an annular "force-generator" portion 301 as suggested in FIGS. 22 and 23. Closure 316 has the shape of a "bowl" in an illustrative embodiment shown in FIG. 21 and suggested in FIG. 29. Although cover 370 is defined by a "round plate" in the illustrated embodiment, cover 370 could take other suitable forms and shapes. Force-generator portion 301 is arranged to surround round plate 370 and is configured to interconnect first seal ring 331 and round plate 370 as suggested in FIGS. 21-24 and 29.

Force-generator portion 301 of lid 314 made of an elastic material that is configured to store energy when compressed and release energy when uncompressed. In an illustrative embodiment, lid 314 is a monolithic member made of such an elastic material. Force-generator portion 301 is shown in an uncompressed state in FIG. 24 (in solid) and in FIG. 29 (in phantom). Force-generator portion 301 is shown in a compressed state in FIG. 25 (in solid) and in FIG. 29 (in solid). When compressed, force-generator portion 301 functions to apply a radially outwardly directed force to first seal ring 331 to yieldably urge the first seal ring radially outwardly away from round plate 370 to mate with radially inwardly facing surface 341 on sloping side wall 340 of paper cup 312 so that a press-plug interference fit between bowl-shaped closure 316 and paper cup 312 is established upon mounting lid 314 on paper cup 312.

Force-generator portion 301 of closure 316 comprises outer frustoconical wall 390 appended to first seal ring 331 and inner frustoconical wall 391 appended to round plate 370 and surrounded by outer frustoconical wall 390 as shown best in FIGS. 22 and 24. These walls 390 and 391 are coupled to one another and cooperate to support round plate 370 as suggested in the drawings, and particularly in FIG. 29. Force-generator portion 301 has a V-shaped cross section as shown, for example, in FIG. 24 and surrounds round plate 370 and mates with first seal ring 331. Inner and outer frustoconical walls 390, 391 cooperate to define an annular channel 302 having a top opening facing away from floor 328 of paper cup 312 as suggested in FIGS. 21, 24, 25, and 29.

Outer frustoconical wall 390 mates with first seal ring 331 at a circular edge 303 lying in a first plane 304 and round plate 370 lies in a second plane 305 located between first plane 304 and floor 328 of paper cup 312 as suggested in FIG. 24. Outer frustoconical wall 390 cooperates with first plane 304 to define an acute included angle therebetween of about 48° when lid 314 is separated from a paper cup 312 as shown, for example, in FIG. 24. Normally, when lid 314 is separated from paper cup 312 as shown in FIG. 24, inner frustoconical wall 391 cooperates with round plate 370 to define an obtuse included angle 307 therebetween of about 137° and outer frustoconical wall 390 cooperates with first seal ring 331 to define an obtuse included angle 309 of about 139° therebetween when lid 314 is separated from paper cup 312 as shown, for example, in FIG. 24.

Lid 314 is configured to employ multiple seals and a "press-plug" interference fit to minimize the leakage and spillage of liquids from liquid reservoir chamber 322 of paper cup 312. Lid 314 includes a "bowl-shaped" closure 316 illustratively comprising round plate 370, first seal ring 331, and force-generator portion 301 as suggested in FIG. 24. Force-generator portion 301 of closure 316 is arranged to interconnect a lower portion of first seal ring 331 and an outer portion of round plate 370 as suggested in FIG. 24. Bowl-shaped closure 316 is shown in an "unsqueezed" (i.e., undeformed) condition in solid in FIG. 24 and in phantom in FIG. 29. Bowl-shaped closure 316 is shown in a "squeezed" (i.e., deformed) condition in solid in FIGS. 25 and 29.

Bowl-shaped closure 316 is made of an elastic material so that it has a deformable and recoverable shape as suggested in illustrative embodiments shown in FIGS. 24, 25, and 29. As suggested in FIGS. 24, 25, and 29, bowl-shaped closure 316 deforms elastically and changes shape as it is inserted into liquid reservoir chamber 322 of paper cup 312 as lid 314 is mounted on brim 320 of paper cup 312 to, for example, retain lid 314 in a mounted position in and on paper cup 312 and establish a tight sealed interference fit between first seal ring 331 of closure 316 and first annular seal surface 341 of paper cup 312. Such an "interference" or "press" fit causes first seal ring 331 to move radially inwardly toward round plate 370 as suggested in FIG. 29 and to decrease an included angle 308 defined between outer and inner frustoconical walls 390, 391 of force generator portion 301 as suggested in FIG. 29. Lid 314 is configured to "plug fit" the inside of paper cup 312 and also to seal against brim 320 of paper cup 312 in several places. This yields multiple seals between lid 314 and paper cup 312 and also helps provide support means for reinforcing upper portion 346 of cup side wall 340 and for blocking inward collapse of upper portion 346 of cup side wall 340 upon impact whenever an external force is applied to paper cup 312 or lid 314.

Figure 28:
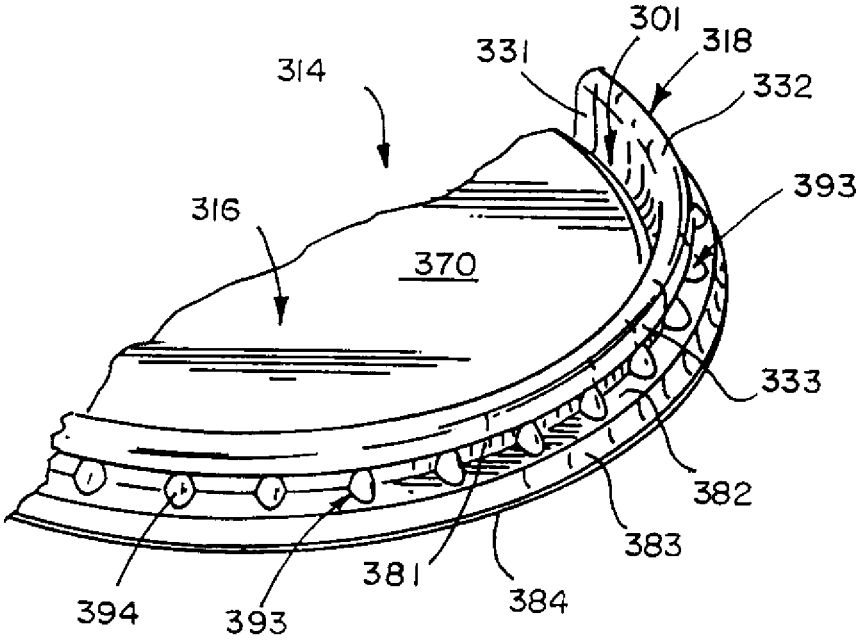
FIG. 28 is an enlarged perspective view of a portion of the lid of FIGS. 21-27 showing a series of radially outwardly projecting and circumferentially spaced-apart protuberances formed in the annular lid-removal flange of the brim mount wherein each of the protuberances has a radially inwardly facing interior surface defining one of the channels included in the annular lid-removal flange.

As shown best in FIGS. 21, 22, and 28, brim mount 318 of lid 314 further includes a series of circumferentially spaced-apart protuberances 393. Each protuberance 393 is arranged to extend upwardly from second annular segment 382 to lid retainer 326. In an illustrative embodiment, each protuberance 393 is characterized by a convex, rounded outer surface 394 that is arranged to face away from top portion 346 of side wall 340 of paper cup 312 when lid 314 is mounted on brim 320 of paper cup 312 and a concave, rounded inner surface 395 that is arranged to face toward top portion 346 when lid 314 is mounted on brim 320.

Figure 26:
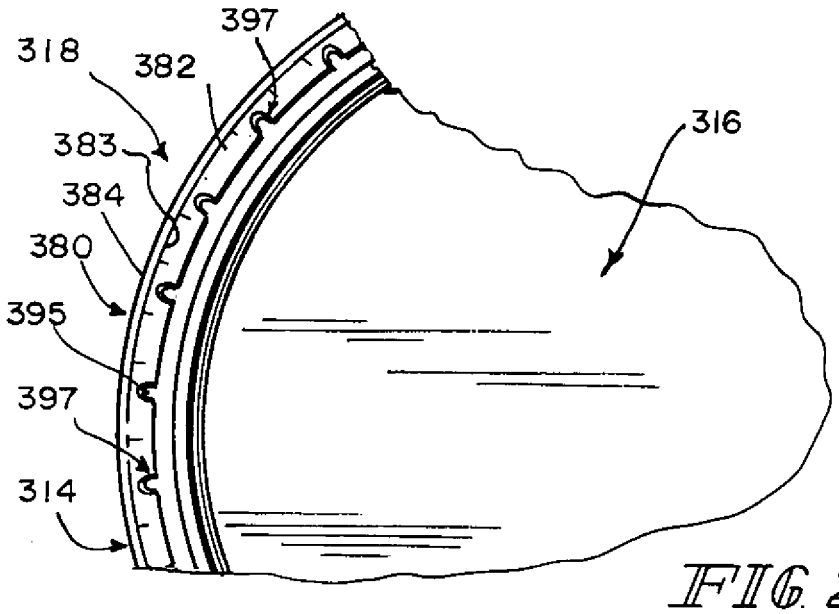
FIG. 26 is an enlarged partial bottom view of the lid of FIGS. 21-25 showing six of the circumferentially spaced-apart channels formed in an annular lid-removal flange included in the brim mount of the lid.
Figure 27:
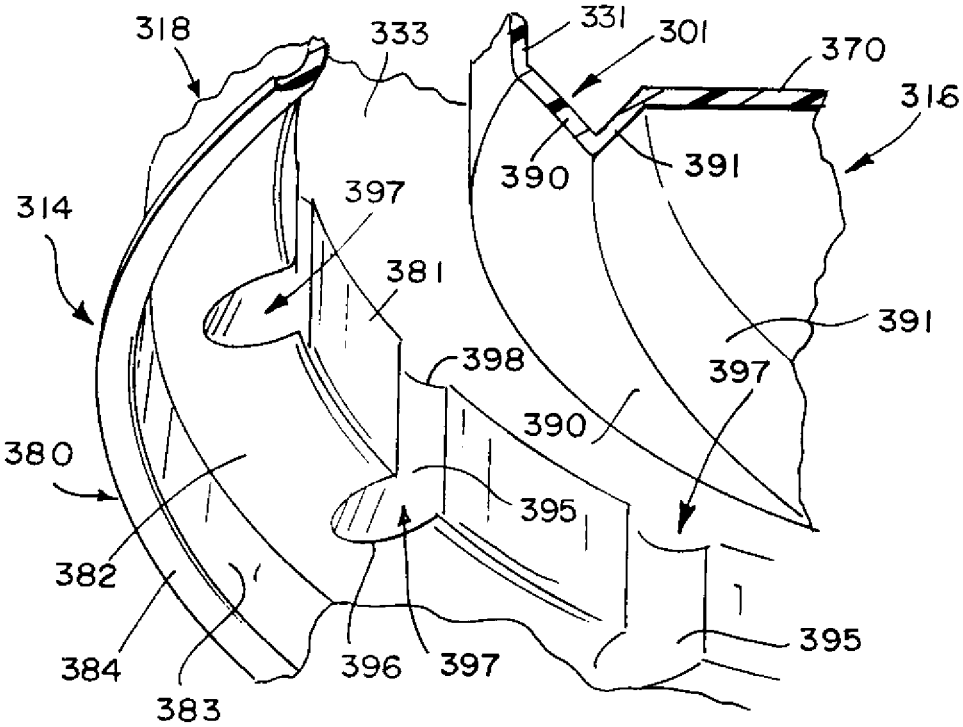
FIG. 27 is a highly enlarged, fragmented, perspective view of a portion of the underside of the lid of FIG. 26 showing three of the channels formed in the annular lid-removal flange.

As shown best in FIGS. 26 and 27, second annular segment 382 in brim mount 318 includes a U-shaped edge 396 associated with each protuberance 393 and formed to define a bottom opening into an interior region or groove 397 bounded by concave, rounded inner surface 395 of a companion protuberance 393. Likewise, lid-removal blocker wall 326 is formed to include a more shallow U-shaped edge 398 associated with each protuberance 393 and formed to define a top opening into the companion interior region 397. As shown, for example, in FIG. 27, first annular segment 381 of lid-removal flange 380 is interrupted by interior regions 397 of protuberances 393. In the illustrated embodiment, closure mount 318 is fluted in that it is marked by a series of radially inwardly facing grooves 397 defined by concave, rounded inner surfaces 395 of protuberances 393.

The invention claimed is:

1. A liquid container comprising a cup including a brim, a floor, and a side wall extending from the brim toward the floor, the side wall including a radially inwardly facing first annular seal surface, the brim including an axially upwardly facing second annular seal surface and a radially outwardly facing third annular seal surface, a lid including a bowl-shaped closure and a brim mount appended to the bowl-shaped closure and configured to cooperate with the bowl-shaped closure to retain the bowl-shaped closure in a position closing a mouth opening into a liquid reservoir chamber formed in the cup, wherein the bowl-shaped closure includes a first seal ring arranged to engage the radially inwardly facing first annular seal surface of the side wall of the cup to establish a first liquid flow barrier therebetween, the brim mount includes a rim coupled to the bowl-shaped closure, a lid-removal flange, and a lid-removal blocker wall interconnecting the rim and the lid-removal flange, the rim includes a second seal ring arranged to engage the axially upwardly facing second annular seal surface of the side wall of the cup to establish a second liquid flow barrier therebetween and a third seal ring arranged to engage the radially outwardly facing third annular seal surface of the side wall of the cup to establish a third liquid flow barrier therebetween, the lid-removal flange is located below the lid-removal blocker wall and arranged to extend downwardly in an inner direction toward the floor of the cup, the lid-removal blocker wall is located between the third seal ring and the lid-removal flange and arranged to engage an outer portion of the brim during movement of the lid in an outer direction opposite to the inner direction, and the bowl-shaped closure further includes a cover and force-generator means interconnecting the cover and the first seal ring for applying a radially outwardly directed force to the first seal ring when the lid is mounted on the cup to urge the first seal ring against the radially inwardly facing first annular seal surface of the side wall of the cup to establish a press-plug interference fit between the lid and the cup, and wherein the force-generator means intersects the first seal ring at a first plane and the force-generator means intersects the cover at a second plane located between the first plane and the floor of the cup.

2. A liquid container comprising a cup including a brim, a floor, and a side wall extending from the brim toward the floor, the brim including a lid retainer lying outside the liquid reservoir chamber formed in the cup, and a lid including a bowl-shaped closure and a brim mount appended to the bowl-shaped closure and coupled to the brim to retain the bowl-shaped closure in a position closing a mouth opening into the liquid reservoir chamber formed in the cup, the brim mount engaging the brim to establish at last one liquid flow barrier therebetween, the brim mount including a lid-removal blocker wall arranged to engage the lid retainer of the brim during movement of the lid in an outer direction away from the floor of the cup to block removal of the lid from the cup, and wherein the bowl-shaped closure includes a first seal ring arranged to engage the side wall of the cup to establish a first liquid flow barrier therebetween when the lid is mounted on the cup, the bowl-shaped closure includes a cover formed to include a liquid-dispenser zone and a force-generator portion having a V-shaped cross section and surrounding the cover and mating with the first seal ring at a first plane, and the force-generator portion includes an outer frustoconical wall coupled to the first seal ring and an inner frustoconical wall arranged to interconnect the outer frustoconical wall and the cover to define a channel having a top opening facing away from the floor of the cup and wherein the force-generator portion intersects the cover at a second plane located between the first plane and the floor of the cup.

3. A liquid container comprising a cup including a brim, a floor, and a side wall extending from the brim to the floor, the side wall including a radially inwardly facing first annular seal surface, and a lid including a closure and a brim mount appended to the closure, wherein the brim mount is coupled to the brim of the cup to retain the closure in a position closing a mouth opening into a liquid reservoir chamber formed in the cup and extending into the liquid reservoir chamber to mate with the radially inwardly facing first annular seal surface, the closure is made of an elastic material and configured to deform elastically when inserted into the mouth opening into the liquid reservoir chamber to establish a sealed tight interference fit between the lid and the cup, and the closure includes a cover arranged to close most of the mouth opening into the liquid reservoir chamber formed in the cup, a first seal ring arranged to surround the cover, and force-generator means interconnecting the cover and the first seal ring for yieldably urging the first seal ring radially outwardly away from the cover to mate with the radially inwardly facing first annular seal surface on the cup upon insertion of the first seal ring into the liquid reservoir chamber through the mouth so that the sealed tight interference fit between the lid and the closure is established, and wherein the force-generator means intersects the first seal ring at a first plane and the force-generator means intersects the cover at a second plane located between the first plane and the floor of the cup.

4. The liquid container of claim 3, wherein the cover of the bowl-shaped closure includes a round plate formed to include a liquid-dispenser zone, the force-generator means has a V-shaped cross section and is arranged to surround the round plate and mate with the first seal ring, the force-generator means includes an outer frustoconical wall coupled to the first seal ring and an inner frustoconical wall arranged to interconnect the outer frustoconical wall and the round plate and cooperate with the outer frustoconical wall to define a channel having a top opening facing away from the floor of the cup.

5. The liquid container of claim 4, wherein the first seal ring is arranged to lie in concentric spaced-apart relation to the cover.

6. A liquid container comprising a cup including a brim, a floor, and a side wall extending from the brim to the floor, the side wall including a radially inwardly facing first annular seal surface, a lid including a closure and a brim mount appended to the closure, wherein the brim mount is coupled to the brim of the cup to retain the closure in a position closing a mouth opening into a liquid reservoir chamber formed in the cup and extending into the liquid reservoir chamber to mate with the radially inwardly facing first annular seal surface, the closure is made of an elastic material and configured to deform elastically when inserted into the mouth opening into the liquid reservoir chamber to establish a sealed tight interference fit between the lid and the cup, and the closure includes a cover arranged to close most of the mouth opening into the liquid reservoir chamber formed in the cup, a first seal ring arranged to surround the cover, and force-generator means surrounding the cover and interconnecting the cover and the first seal ring for yieldably urging the first seal ring radially outwardly away from the cover to mate with the radially inwardly facing first annular seal surface on the cup upon insertion of the first seal ring into the liquid reservoir chamber through the mouth so that the sealed tight interference fit between the lid and the closure is established, and wherein the force-generator means intersects the first seal ring at a first plane and the force-generator means intersects the cover at a second plane located between the first plane and the floor of the cup.

* * * * *